US009101976B2

(12) United States Patent
Bergeron et al.

(10) Patent No.: US 9,101,976 B2
(45) Date of Patent: Aug. 11, 2015

(54) DIE CASTING MACHINE AND METHOD

(75) Inventors: Stephane Bergeron, Boucherville (CA); Alain Bourbonnais, Montreal (CA); Samuel Dubois, Greenfield Park (CA); Richard Laveau, Lachenaie (CA); Gilbert Monette, St-Hubert (CA); Jean-Pierre Ouellet, Ste-Julie (CA); Carl Thibault, Varennes (CA)

(73) Assignee: IMAC Inc., Quebec (CA)

( * ) Notice: Subject to any disclaimer, the term of this patent is extended or adjusted under 35 U.S.C. 154(b) by 0 days.

(21) Appl. No.: 13/976,575

(22) PCT Filed: Dec. 29, 2010

(86) PCT No.: PCT/CA2010/002069

§ 371 (c)(1),
(2), (4) Date: Jun. 27, 2013

(87) PCT Pub. No.: WO2012/088580

PCT Pub. Date: Jul. 5, 2012

(65) Prior Publication Data

US 2013/0269903 A1 Oct. 17, 2013

(51) Int. Cl.

| | |
|---|---|
| ***B22D 17/08*** | (2006.01) |
| ***B22D 17/26*** | (2006.01) |
| ***B22D 17/04*** | (2006.01) |
| ***B22D 17/02*** | (2006.01) |

(52) U.S. Cl.

CPC ..... *B22D 17/08* (2013.01); *B22D 17/02* (2013.01); *B22D 17/04* (2013.01); *B22D 17/26* (2013.01)

(58) Field of Classification Search

CPC ..... B22D 17/08; B22D 17/26; B29C 45/1747

USPC ..... 164/113, 137, 303–318, 339

See application file for complete search history.

(56) References Cited

U.S. PATENT DOCUMENTS

| | | | |
|---|---|---|---|
| 2,112,342 | A | 3/1938 | Lester |
| 3,208,113 | A | 9/1965 | Bennett |
| 3,650,423 | A | 3/1972 | O'Brien |
| 3,923,201 | A | 12/1975 | Hersh et al. |
| 3,977,461 | A | 8/1976 | Pol et al. |

(Continued)

FOREIGN PATENT DOCUMENTS

| | | | |
|---|---|---|---|
| EP | 1486276 | A2 | 12/2004 |
| EP | 1601480 | A1 | 12/2005 |
| JP | 64034555 | | 2/1989 |

*Primary Examiner* — Kevin E Yoon

(74) *Attorney, Agent, or Firm* — Fraser Clemens Martin & Miller LLC; James D. Miller

(57) ABSTRACT

The die casting machine comprises a mold closing actuator capable of selectively inducing a closing pressure on first and second platens for forcing them towards a closed position in which their mold portions are pressed against each other along a parting line. An injection sleeve is movable relative to the mold portions between a distal position in which the injection sleeve and the mold portions are spaced apart; and an injection position in which the injection sleeve engages the mold portions at an inlet opening when the first and second platens are in their closed position. The injection sleeve applies a transverse contact pressure when it engages the mold portions. The closing pressure is unevenly distributed on the platens so as to compensate the transverse contact pressure to have a resulting effective molding pressure on the mold portions that is substantially evenly distributed across the parting line.

23 Claims, 12 Drawing Sheets

(56) References Cited

U.S. PATENT DOCUMENTS

| | | | | | |
|---|---|---|---|---|---|
| 4,417,845 | A | | 11/1983 | Burton | |
| 4,516,699 | A | | 5/1985 | Burton et al. | |
| 4,615,857 | A | | 10/1986 | Baird | |
| 4,655,274 | A | * | 4/1987 | Dannoura | 164/341 |
| 4,799,531 | A | | 1/1989 | Yamamoto et al. | |
| 4,955,426 | A | | 9/1990 | Akimoto et al. | |
| 5,123,834 | A | | 6/1992 | Joyner | |
| 5,127,467 | A | | 7/1992 | Ueno | |
| 5,284,201 | A | * | 2/1994 | Hegel et al. | 164/312 |
| 5,381,855 | A | | 1/1995 | Mezger | |
| 5,388,631 | A | * | 2/1995 | Suganuma et al. | 164/72 |
| 5,593,711 | A | | 1/1997 | Glaesener | |
| 5,638,888 | A | | 6/1997 | Perrella et al. | |
| 5,776,402 | A | | 7/1998 | Glaesener | |
| 5,787,962 | A | | 8/1998 | Perrella et al. | |
| 6,027,329 | A | | 2/2000 | Nazarian et al. | |
| 6,334,479 | B1 | | 1/2002 | Pollak et al. | |
| 6,439,876 | B1 | | 8/2002 | Glaesener | |
| 6,609,554 | B2 | | 8/2003 | Pollak et al. | |
| 6,619,371 | B1 | | 9/2003 | Lauper | |
| 6,746,232 | B2 | | 6/2004 | Becker et al. | |
| 6,779,585 | B2 | | 8/2004 | Zumberger et al. | |
| 6,951,238 | B2 | | 10/2005 | Hirai et al. | |
| 6,978,823 | B2 | | 12/2005 | Thibault et al. | |
| 7,021,361 | B2 | | 4/2006 | Hara et al. | |
| 7,025,115 | B2 | | 4/2006 | Doty | |
| 7,036,553 | B1 | | 5/2006 | Yu | |
| 7,080,978 | B2 | | 7/2006 | Glaesener | |
| 7,165,598 | B2 | | 1/2007 | DasGupta | |
| 7,296,611 | B2 | | 11/2007 | Hirai et al. | |
| 7,318,721 | B2 | | 1/2008 | Spicer et al. | |
| 2007/0267166 | A1 | | 11/2007 | Harada et al. | |

* cited by examiner

DIE CASTING MACHINE AND METHOD

FIELD OF THE INVENTION

The present invention relates to die casting machines.

BACKGROUND OF THE INVENTION

Die casting machines are used to mold metallic articles. To do so, liquid metal is fed into the inner cavity of a mold where the metal hardens as it is cooled before the article is ejected from the mold. The process is repeated in a cycle to create numerous articles.

Molds typically comprise two mold portions that join at a so-called parting line that is in fact a plane along which mold surfaces of each mold portion engage one another. The mold portions both have recesses on these flat mold surfaces that form the inner mold cavity for liquid metal injection when the mold portions join. The mold portions can be separated to eject the metallic article once it is hard. In some molds, one of the mold portions is fixed and the other is mobile while in other instances, both mold portions are mobile. In both cases, the mold portions are movable relative to each other between a closed position in which the mold portions engage one another and an opened position in which the mold portions are spaced apart.

Die casting machines come in different types that are categorized in two groups: cold chamber die casting machines and hot chamber die casting machines.

A cold chamber die casting machine is typically used to mold aluminum pieces or sometimes pieces of another metal. In a cold chamber die casting machine, the injection sleeve (called the "shot sleeve") is not partly submerged or otherwise surrounded by liquid metal. Rather, liquid metal is conveyed from a furnace located distally from the injection sleeve, to the injection sleeve, for example with a ladle that is operated by an automated arm or manually. The metal is consequently cyclically fed into the injection sleeve by this ladle before the ladle returns to the furnace to be refilled. While the ladle is being refilled, the injection sleeve injects the liquid metal into the mold cavity. A biscuit will desirably form at the inlet opening of the mold where the piston applies and maintains pressure against the metal while it hardens. The biscuit, usually of generally cylindrical shape, comprises hardened metal that is located partly in the shot sleeve and partly in the mold cavity at the cavity inlet opening, but that will not form part of the article being molded. Once the article is suitably hard, it will be ejected together with the biscuit, with the latter being disposed of for example by being returned to the furnace for the metal to be melted and reused.

A hot chamber die casting machine is typically used to mold zinc and magnesium pieces. It comprises a bath filled with molten liquid metal in which an injection sleeve, provided with a gooseneck in hot chamber die casting machines, is partly submerged. Liquid metal is allowed to cyclically flow into an inner chamber of the injection sleeve through an inlet opening to fill the inner chamber before a piston ejects the liquid metal out of the inner chamber and into the mold cavity, through an injection nozzle of the gooseneck provided on the injection sleeve. The liquid metal never completely hardens within the injection chamber or the injection nozzle and there is no formation of a biscuit in hot chamber die casting machines.

Hot chamber and cold chamber die casting machines each have respective operation characteristics, as known to those skilled in the art. It will be noted that principles that are applicable for hot chamber die casting machines are often not applicable for cold chamber die casting machines, and vice versa, due to differences in these operation characteristic. For example, the types of injection sleeves that are used differ (the injection sleeve in hot chamber die casting machines comprises a gooseneck having a nozzle while it doesn't in cold chamber die casting machines), the injection pressures differ, the formation of a biscuit in cold chamber die casting incurs cold-chamber specific requirements regarding injection pressures and mold-closing pressures; together with many other design and operation characteristics that are specific to the type of die casting machine—hot or cold—being used.

Concerning the biscuit mentioned above, it is noted that in cold chamber die-casting machines the metal will also harden within the passage called the runner which links the mold inlet opening to the gate, the latter being the entry point for the liquid metal into the mold cavity. So in fact, it is not only the biscuit that will be disposed of after the metal hardens, but also the diametrically smaller extraneous metal that extends between the biscuit and the gate in the runner. The gate is the point where the metal is distributed from the runner into the actual article cavity.

In known cold chamber dies casting machines, one platen is fixed while the other is mobile. The injection sleeve that injects the liquid metal into the mold cavity extends through the fixed platen and the corresponding fixed mold portion. One problem with prior art cold chamber die casting machines is linked to the feeding of liquid metal into the injection sleeve. Cold chamber injection sleeves comprise a piston movable within an elongated inner chamber, with the piston being capable of ejecting the liquid metal out through a liquid metal outlet port of the injection sleeve. In many cases, the injection sleeve is disposed horizontally and a liquid metal inlet port is provided atop the cylindrical sleeve, away from the outlet opening. The inner chamber is partly filled with liquid metal through the inlet opening, while the outlet opening is in fluid communication with the mold cavity. A problem with this configuration is that the horizontal disposition of the injection sleeve allows air to remain present in very significant proportion in the injection sleeve when the injection sleeve filling operation is completed but before the injection step starts. Indeed, the starting position of the piston will be the same notwithstanding the volume of injected liquid and consequently the injection sleeve will usually be filled only partly as a result of varying volumes being used to mold articles of different sizes. If the injection sleeve is half filled with molten metal, then it is also half filled with air. Consequently, a significant volume of air is often injected into the mold cavity concurrently with liquid metal, resulting in air bubbles being entrapped in the liquid metal in the mold. Although some known techniques exist to exhaust the entrapped air within the mold cavity, some air will often remain trapped, resulting in the metallic article comprising weakness zones once the metal is hardened where air bubbles are present.

Another injection sleeve configuration exists where the injection sleeve is provided with a single liquid metal port that is located at the free extremity of the injection sleeve and that is used both for filling the injection sleeve and for injecting the liquid metal into the mold. In this configuration, the injection sleeve is inclined to retain the liquid metal therein as it is being poured, thereby maximizing the volume of the injection sleeve inner chamber that is filled with liquid metal and consequently minimizing the volume of the injection sleeve that is occupied by air. However, this injection sleeve design suffers from at least one problem: the injection sleeve liquid metal port is located within the mold itself, forcing the feeding of the metal to be accomplished in an area between the two mold halves that is not easily accessible for a robotised arm. Significant design sacrifices have to be done on the die casting machine to accommodate such a configuration.

Positioning the injecting sleeve outside of the mold entirely and injecting the liquid metal at the parting line instead of between the two mold halves, has up to now not been seen as an operable or viable option in cold chamber die casting machines. Some prior art hot chamber die casting machines include injection at the parting line with the injection nozzle located outwardly of the mold. These hot chamber die casting machines have mold portions that close over the free metal liquid outlet extremity of the injection sleeve and the injection sleeve engages the mold at the parting line to inject the liquid metal parallel to and through the parting line into the mold cavity. In the case of hot chamber die casting machines, this design is possible since the injection force is relatively low.

However, in cold chamber die casting machines where injection forces are more important, this design with injection at the parting line is considered non-functional or non-practical and is not used in prior art devices to the knowledge of the present inventors. For one thing, the seal between the injection sleeve and the mold needs to be fluid-tight, as otherwise the liquid metal will be allowed to undesirably seep between the injection sleeve and the mold. To obtain a fluid-tight seal at important injection forces requires at the very least that the injection sleeve engage the mold at an important sleeve-mold sealing pressure. Since this sleeve-mold sealing pressure would be applied transversely of the mold, parallel to the parting line, this is likely to result in the mold being deformed by curving transversely unless the mold closing pressure is so important that it would counteract this deformation. Such a mold deformation would be undesirable since it would contribute to allowing the liquid metal to flash within the mold during the injection as a result of unevenly distributed pressure on the mold portions; while increasing the mold closing pressure significantly to counteract this deformation means that the die casting machine needs to be equipped with more expensive components in addition to more energy being expended to operate the die casting machine. In any event, by increasing the sleeve-mold sealing pressure, the mold is likely to wear down under the repeated pressured engagement of the sleeve on the mold. The mold wearing down at the junction area with the injection sleeve means that it might become uneven, resulting in the sleeve-mold sealing pressure being applied unevenly, in turn resulting in the metal seeping out between the injection sleeve and the mold during injection.

For these reasons and others, it has been considered common wisdom up to now to entirely avoid having a cold chamber die casting machine where the injection sleeve injects liquid metal at the parting line.

Air bubbles in the liquid metal also appear during the liquid metal pouring operation from the ladle into the injection sleeve, as a result of turbulence from the liquid metal inflow.

Another problem related to prior art die casting machines relates to liquid metal seeping outside of the inner mold cavity, between the mold portions. This undesirable seeping is called "flashing". Reasons why the liquid metal flashes is because the pressure applied to keep the two mold portions pressed against each other is not important enough or is not well distributed along the parting line. One reason why this mold-closing pressure needs to be very important is to allow liquid metal injection at high pressure without the liquid metal flashing, the high pressure injection providing articles of higher quality.

SUMMARY OF THE INVENTION

A cold chamber die casting machine comprising:

first and second platens each holding respective first and second mold portions, said first and second platens being mounted to a base and being movable relative to one another along a longitudinal axis between an open position in which said first and second mold portions are spaced apart and a closed position in which said first and second mold portions are pressed against each other along a parting line to form a mold;

a mold cavity formed between and enclosed by said first and second mold portions when said first and second platens are in their closed position;

a mold closing actuator capable of selectively inducing a closing pressure on said first and second platens for forcing said first and second platens towards their closed position;

an inlet opening formed on said mold at said parting line and allowing access into said mold cavity when said platens are in their closed position for injecting liquid metal into said mold cavity;

an injection mechanism mounted to said base comprising an injection sleeve having an inner chamber and a liquid metal injection port, and an injector for forcing liquid metal from said inner chamber out through said liquid metal port, said injection sleeve being movable relative to said mold along a transversal axis between a distal position in which said liquid metal injection port and said inlet opening are spaced apart; and an injection position in which said injection sleeve engages said mold to form a seal about said inlet opening and said liquid metal injection port when said first and second platens are in their closed position, with said liquid metal injection port then being in liquid communication with said inlet opening for allowing liquid metal to be injected from said injection sleeve inner chamber into said mold cavity, with said transversal axis being transversal to said longitudinal axis.

In one embodiment, the cold chamber die casting machine further comprises:

a first male-female interface member provided on said injection sleeve around said liquid metal injection port; and a second male-female interface member provided on said mold around said inlet opening;

wherein said first and second male-female interface members are complementary to form a male-female engagement seal between said injection sleeve and said mold around said liquid metal injection port and said inlet opening when said injection sleeve and said mold are in said injection position.

In one embodiment, said first male-female interface member comprises a female interface member and said second male-female interface member comprises a male interface member.

In one embodiment, said male interface member comprises an annular convex outer surface and said female interface member comprises an annular concave outer surface engageable against said male interface member annular convex outer surface to create a male-female engagement seal about said inlet opening and said liquid metal injection port.

In one embodiment, said male interface member annular convex outer surface has a radius of curvature which is smaller than the radius of curvature of said female interface member annular concave outer surface at the point of contact between said male and female interface members when said male-female engagement seal is created, for providing a substantially linear circular contact between said male and female interface members.

In one embodiment, said mold closing actuator comprises means for unevenly distributing said closing pressure on said first and second platens for compensating an injection sleeve contact pressure along said transversal axis resulting from said injection sleeve engaging said mold at said injecting position, to have a resulting effective closing pressure on said mold portions that is substantially evenly distributed across said parting line.

In one embodiment, said means for unevenly distributing said closing pressure on said first and second platens comprises tie bars parallel to said longitudinal axis and linked to said first and second platens, and a mold closing pressure inducing mechanism capable of inducing said closing pressure on said first and second platens via said tie bars for forcing said first and second platens towards their closed position, with said tie bars being disposed asymmetrically relative to said longitudinal axis for unevenly distributing said closing pressure on said first and second platens for compensating an injection sleeve contact pressure along said transversal axis resulting from said injection sleeve engaging said mold at said injecting position to have a resulting effective molding pressure on said mold portions that is substantially evenly distributed across said parting line.

In one embodiment, said tie bars are linked to said platens by means of tie bar support members that are more resilient than said platens and are allowed to resiliently deform when said closing pressure is applied to said first and second platens via said tie bar support members and said tie bars.

In one embodiment, said first platen defines a front side on which said first mold portion is installed, a back side opposite said front side and an outer peripheral surface extending between said front and back sides, said second platen defines a front side on which said second mold portion is installed, a back side opposite said front side and an outer peripheral surface extending between said front and back sides, wherein said tie bar support members comprise:

a first resilient tie bar support member attached to the first platen back side and protruding beyond the first platen peripheral surface; and a second resilient tie bar support member attached to the second platen back side and protruding beyond the second platen peripheral surface;

and wherein said mold closing pressure inducing mechanism induces said closing pressure on said first and second platens via said first and second tie bar support members and said tie bars for forcing said first and second platens towards their closed position, said first and second support members resiliently deforming in a direction generally parallel to said longitudinal axis and towards one another.

In one embodiment, said tie bars comprise a first and a second tie bars that are positioned in offset fashion opposite said injection sleeve relative to said longitudinal axis.

In one embodiment, said first tie bar support member is elongated and defines opposite end portions that protrude beyond said peripheral edge of said first platen, and said second tie bar support member is elongated and defines opposite end portions that protrude beyond said peripheral edge of said second platen, with said first tie bar engaging registering end portions of said first and second tie bar support members and said second tie bar engaging registering end portions of said first and second tie bar support members.

In one embodiment, said first tie bar support member comprises a pair of spaced-apart first tie bar support plates, with said first and second tie bars each extending through both first tie bar support plates, and wherein said second tie bar support member comprises a pair of spaced-apart second tie bar support plates, with said first and second tie bars each extending through both second tie bar support plates.

In one embodiment, said first tie bar support member further comprises a first web linking said first tie bar support plates between said first and second tie bars and wherein said second tie bar support member further comprises a second web linking said second tie bar support plates between said first and second tie bars.

In one embodiment, said mold closing pressure inducing mechanism comprises tie bar sockets that attach said tie bars at a first end thereof to said first tie bar support member and high-pressure hydraulic cylinders acting on said tie bars at a second end thereof and attached to said second tie bar support member.

In one embodiment, said injection sleeve is fixed in translation to said base and said platens are movably mounted to said base so as to allow said injection sleeve to be movable relative to said mold between said distal and injection positions.

In one embodiment, said platens are mounted to said base by means of a transverse track member that allows said platens to move towards and away from said injection sleeve along said transversal axis, said die casting machine comprising a platen transverse actuator for selectively moving said platens along said transverse track member towards and away from said injection sleeve.

In one embodiment, said transverse track member is parallel to said transversal axis and is fixedly supported on said base in an inclined fashion at an angle ranging between 1° and 90° relative to a horizontal plane so that said platens will move down as they move towards said injection sleeve and up as they move away from said injection sleeve.

In one embodiment, said injection sleeve is elongated and is inclined so as to be parallel to said transversal axis, with said injection sleeve liquid metal port being located higher than said injection sleeve inner chamber.

In one embodiment, said transversal axis has an angle of approximately 45° relative to a horizontal plane.

In one embodiment, said injection sleeve is mounted to said base by means of a pivotal joint so as to be pivotable about an injection sleeve reference axis, said die casting machine further comprising an injection sleeve biasing member continuously biasing said injection sleeve towards said injection sleeve reference axis.

In one embodiment, said platens are carried by a longitudinal track member allowing said platens to move along said longitudinal axis, said longitudinal track member being in turn movable along said transverse track member, said die casting machine further comprising a platen longitudinal actuator for allowing said platens to move along said longitudinal track member.

In one embodiment, said mold cavity comprises an inner runner that extends away from said inlet opening in line with said injection sleeve.

In one embodiment, said injector comprises a plunger movable within said inner chamber for forcing liquid metal out of said inner chamber, said die casting machine comprising a linear guide member attached to said base and linked to said plunger for guiding said plunger as it moves.

In one embodiment, said injector comprises a plunger movable within said inner chamber for forcing liquid metal out of said inner chamber, said cold chamber die casting machine further comprising a plunger lubrication device for lubricating a head portion of said plunger.

The invention also relates to a method of molding a metallic article in a cold chamber die casting machine of the type comprising:

first and second platens each holding respective first and second mold portions, said first and second platens being movable relative to one another along a longitudinal axis between an open position in which said first and second mold portions are spaced apart and a closed position in which said first and second mold portions are pressed against each other along a parting line to form a mold;

a mold cavity formed between and enclosed by said first and second mold portions when said first and second platens are in their closed position;

a mold closing actuator capable of selectively inducing a closing pressure on said first and second platens for forcing said platens towards their closed position;

an inlet opening formed on said mold at said parting line and allowing access into said mold cavity when said platens are in their closed positions; and an injection mechanism comprising a sleeve having an inner chamber and a liquid metal injection port, and an injector;

said method comprising the steps of:

filling at least partly said injection sleeve inner chamber with liquid metal;

relatively moving said first and second platens into said closed position;

relatively moving said injection sleeve and said mold along a transversal axis between a distal position in which said liquid metal injection port and said inlet opening are spaced apart; and an injection position in which said injection sleeve engages said mold around said inlet opening to form a seal between said injection sleeve and said mold about said inlet opening and said liquid metal injection port, with said liquid metal injection port then being in liquid communication with said inlet opening, with said transversal axis being transversal to said longitudinal axis;

injecting liquid metal from said injection sleeve inner chamber into said mold cavity with said injector;

allowing said liquid metal to cool and harden inside said mold cavity whereby the metallic article will be molded;

relatively moving said injection sleeve and said mold away from said injection position;

relatively moving said first and second platens away from their closed position; and retrieving the metallic article from the mold.

In one embodiment, said injection sleeve is fixedly mounted in translation to a base and wherein said platens are movably mounted in translation to said base so as to be movable along said longitudinal axis and also along said transversal axis towards and away from said injection sleeve, the step of relatively moving said injection sleeve and said mold comprising moving said platens towards said injection sleeve along said transversal axis.

In one embodiment, said mold cavity comprises a runner that extends away from said inlet opening in alignment with said injection sleeve when said injection sleeve and said mold are in said injection position, with the step of injecting liquid metal from said injection sleeve inner chamber into said mold cavity with said injector comprising injecting liquid metal in a straight line from said injection sleeve and along said runner.

In one embodiment, the method further comprises the following steps:

providing a first male-female interface member on said injection sleeve around said liquid metal injection port;

providing a second male-female interface member on said mold around said inlet opening, said first and second male-female interface members being complementary so as to be capable of forming said engagement seal.

The invention also relates to a hot chamber die casting machine comprising:

first and second platens each holding respective first and second mold portions, said first and second platens being mounted to a base and being movable relative to one another along a longitudinal axis between an open position in which said first and second mold portions are spaced apart and a closed position in which said first and second mold portions are pressed against each other along a parting line to form a mold;

a mold cavity formed between and enclosed by said first and second mold portions when said first and second platens are in their closed position;

a mold closing actuator capable of selectively inducing a closing pressure on said first and second platens for forcing said first and second platens towards their closed position;

an inlet opening formed on said mold at said parting line and allowing access into said mold cavity when said platens are in their closed position for injecting liquid metal into said mold cavity;

an injection mechanism mounted to said base comprising an injection sleeve having an inner chamber and a liquid metal injection port, and an injector for forcing liquid metal from said inner chamber out through said liquid metal port, said injection sleeve being movable relative to said mold along a transversal axis between a distal position in which said liquid metal injection port and said inlet opening are spaced apart; and an injection position in which said injection sleeve engages said mold to form a seal about said inlet opening and said liquid metal injection port when said first and second platens are in their closed position, with said liquid metal injection port then being in liquid communication with said inlet opening for allowing liquid metal to be injected from said injection sleeve inner chamber into said mold cavity, with said transversal axis being transversal to said longitudinal axis;

wherein said mold closing actuator comprises means for unevenly distributing said closing pressure on said first and second platens for compensating an injection sleeve contact pressure along said transversal axis resulting from said injection sleeve engaging said mold at said injecting position, to have a resulting effective closing pressure on said mold portions that is substantially evenly distributed across said parting line.

The present invention further relates to a method of applying pressure on first and second mold portions during a molding operation in a die casting machine of the type comprising:

a first platen holding said first mold portion and a second platen holding said second mold portion, said first and second platens being movable relative to one another along a longitudinal axis between an open position in which said first and second mold portions are spaced apart and a closed position in which said first and second mold portions are pressed against each other along a parting line to form a mold;

a mold cavity formed between and enclosed by said first and second mold portions when said first and second platens are in their closed position, with said parting line extending within said mold cavity;

a mold closing actuator capable of selectively inducing a closing pressure along said longitudinal axis on said first and second platens for forcing said platens towards their closed position;

an inlet opening formed on said mold at said parting line and allowing access into said mold cavity when said platens are in their closed positions;

an injection mechanism comprising an injection sleeve having an inner chamber and a liquid metal injection port, and an injector, said platens and said injection sleeve being capable of relatively moving along a transversal axis between a distal position in which said liquid metal injection port and said inlet opening are spaced apart; and an injection position in which said injection sleeve engages said mold around said inlet opening when said first and second platens are in their closed position, with said liquid metal injection port then being in liquid communication with said inlet opening for allowing liquid metal to be injected from said injection sleeve inner chamber into said mold cavity, and with said transversal axis being transversal to said longitudinal axis; and a transverse actuator capable of selectively inducing a transverse contact pressure along said transversal axis between said injection sleeve and said platens for relatively forcing said platens and said injection sleeve towards their injection position;

said method comprising the steps of:

relatively positioning said first and second platens in said closed position;

applying said closing pressure on said platens with said mold closing actuator;

relatively positioning said injection sleeve and said platens in said injection position;

applying said transverse contact pressure between said platens and said injection sleeve with said transverse actuator;

wherein said closing pressure is unevenly distributed on said platens so as to compensate said transverse contact pressure to have a resulting effective molding pressure on said mold portions that is substantially evenly distributed across said parting line.

In one embodiment, the step of relatively positioning said injection sleeve and said platens in said injection position is accomplished by said transverse actuator relatively moving said injection sleeve and said platens between said distal position and said injection position.

In one embodiment, said platens are movable in translation along said transversal axis relative to a base and said injection sleeve is fixed in translation to said base, said injection sleeve being elongated and positioned in an inclined fashion relative to a horizontal plane so that said liquid metal port will be higher than said inner chamber and so as to be substantially parallel to said transversal axis, the step of said transverse actuator relatively moving said injection sleeve and said platens between said distal position and said injection position being accomplished by moving said platens along said transversal axis in such a way that said platens will move down as they move towards said injection sleeve and up as they move away from said injection sleeve.

In one embodiment, the step of relatively positioning said first and second platens in said closed position is accomplished by moving said platens along said longitudinal axis along a longitudinal track member by means of a platen longitudinal actuator, said longitudinal track member in turn being movable by means of said transverse actuator along a transverse track member parallel to said transversal axis.

In one embodiment, said die casting machine is a cold chamber die casting machine.

In one embodiment, said die casting machine is a hot chamber die casting machine.

The invention also relates to a method of cyclically filling an injection sleeve of a die casting machine with liquid metal and ejecting the liquid metal out of said injection sleeve, said injection sleeve comprising an elongated inner chamber comprising opposite first and second ends, an open liquid metal port at said inner chamber second end and an ejector movable within said inner chamber between said first and second ends, said method comprising cyclically repeating the steps of:

positioning said ejector at a starting position located away from said inner chamber first end towards said inner chamber second end;

pouring liquid metal into said inner chamber through said liquid metal port;

retracting said ejector towards a retracted position away from said starting position while the liquid metal is being poured into said inner chamber; and after the liquid metal has been poured into said inner chamber, ejecting the liquid metal from said inner chamber by moving said ejector towards said inner chamber second end.

In one embodiment, said starting position of said ejector is located substantially at said inner chamber second end.

In one embodiment, said starting position of said ejector is spaced from said inner chamber second end towards said inner chamber first end.

In one embodiment, the step of ejecting the liquid metal from said inner chamber by moving said ejector towards said inner chamber second end comprises said ejector reaching said inner chamber second end.

In one embodiment, the step of ejecting the liquid metal from said inner chamber by moving said ejector towards said inner chamber second end comprises said ejector stopping short of said inner chamber second end.

In one embodiment, the step of positioning said ejector at a starting position located away from said inner chamber first end towards said inner chamber second end comprises positioning said ejector at said inner chamber second end.

In one embodiment, the step of positioning said ejector at a starting position located away from said inner chamber first end towards said inner chamber second end comprises positioning said ejector away from said inner chamber second end.

In one embodiment, the method further comprises the following step after the step of pouring liquid metal into said inner chamber but before the step of ejecting the liquid metal from said inner chamber: moving said ejector to a pre-ejection position located away from said retracted position to help exhaust air from the liquid metal before it is ejected from said inner chamber.

The present invention further relates to a method of carrying molten metal in a ladle of a die casting machine in a conveyance direction from a furnace at which said ladle is filled with liquid metal to an injection sleeve in which the liquid metal is poured from said ladle, said method comprising the steps of:

accelerating said ladle away from said furnace as said ladle leaves said furnace;

decelerating said ladle as it approaches said injection sleeve; and while said ladle accelerates and decelerates, tilting said ladle to maintain a same relative position of the liquid metal within said ladle.

In one embodiment, said ladle defines opposite top and bottom ends, a hollow main body and a mouth opening at said top end, the step of tilting said ladle to maintain a same relative position of the liquid metal within said ladle comprising tilting said ladle so that said mouth opening will face partly in said conveyance direction when said ladle accelerates.

In one embodiment, the step of tilting said ladle to maintain a same relative position of the liquid metal within said ladle comprising tilting said ladle so that said mouth opening will face partly away from said conveyance direction when said ladle decelerates.

DETAILED DESCRIPTION OF THE EMBODIMENTS

Figure 1:
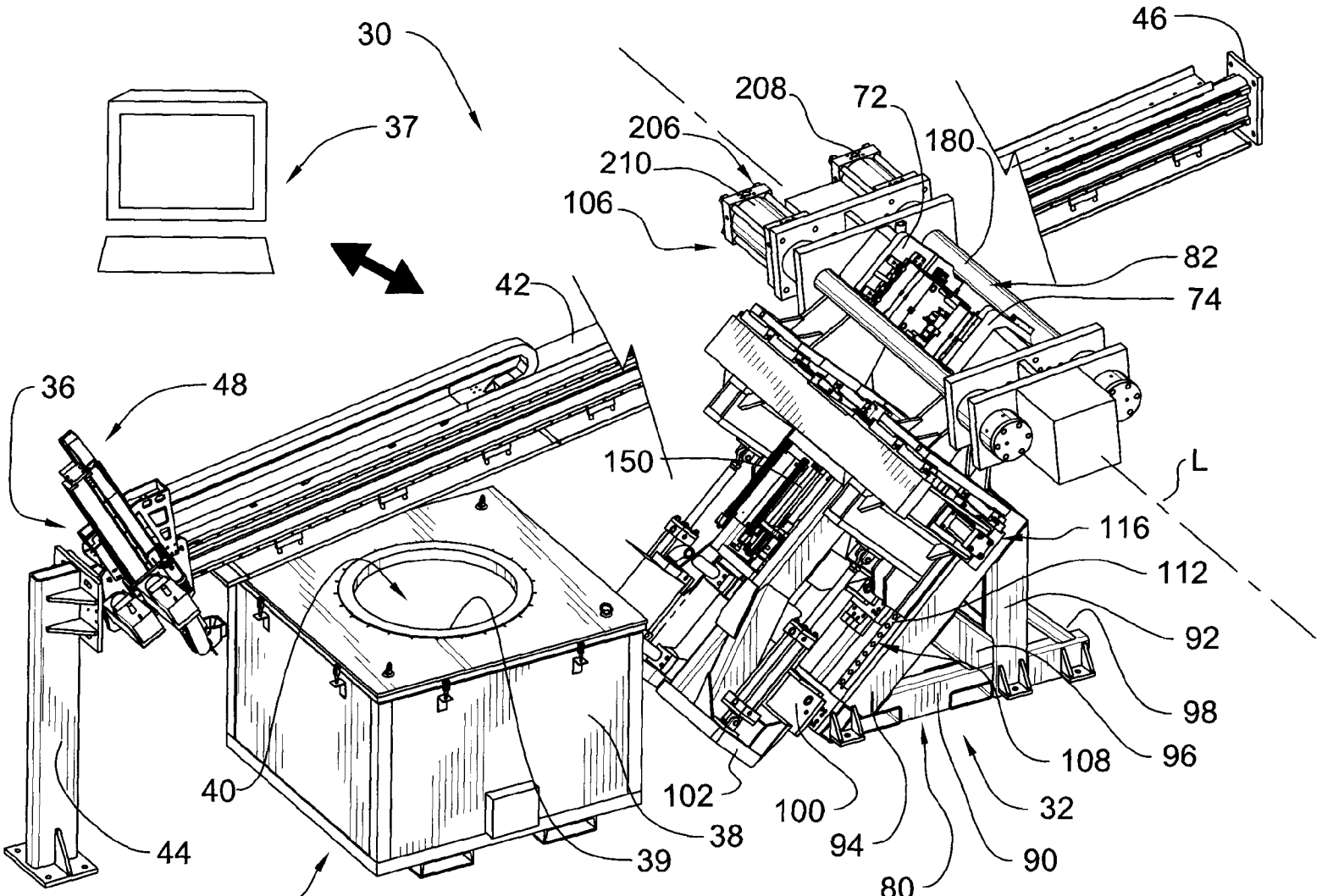
FIG. 1 is a perspective view of a die casting machine according to the present invention, with the rail member being shown partly broken, with the computer being shown schematically, with the injection sleeve and mold being in their distal position and with the platens and mold portions being in their opened position.

FIG. 1 shows a die casting machine 30 generally comprising a molding section 32, a furnace 34, a molten metal conveyor 36 and a computer 37. In use, and as detailed hereinafter, molten metal is conveyed from furnace 34 to molding section 32 with conveyor 36 to mold metallic articles at molding section 32. These steps are intended to be repeated in a cycle, under control and synchronisation by computer 37, for allowing multiple metallic articles to be molded with die casting machine 30.

Furnace 34 is of known construction and comprises a housing 38 having an upper opening 39 allowing access into an inner chamber 40 comprising a crucible wherein molten metal is maintained at a temperature above its fusion point. This metal reserve will be filled when necessary with metallic ingots that will melt to a liquid state to replenish the liquid metal reserve. The temperature of furnace 34 may be controlled by computer 37, although it could alternately be controlled independently directly at the crucible of furnace 34. Computer 37 may be linked to furnace 34 through any suitable communication means, such as wired or wireless communication means.

Conveyor 36 comprises a rail member 42 supported spacedly over ground by a ground post 44 that holds a first end thereof and by a wall attachment 46 that holds a second end thereof. In FIG. 1, rail member 42 is partly broken for illustrative purposes, but it is understood that it extends in uninterrupted fashion from ground post 44 to wall attachment 46. Any other suitable attachment means to support rail member 42 over ground could also be used.

FIGS. 1, 2 and 8-10 show that rail member 42 carries a robotic arm 48 that is movable along rail member 42. Robotic arm 48 comprises a carriage 50 that slidably or rollably engages rail member 42, a motor 52 for moving carriage 50 along rail member 42 and displacement means (not shown, such as wheels or a rack and gear system) that are activated by motor 52 to allow the displacement of carriage 50 along rail member 42. Robotic arm 48 also comprises a track 54 that is fixed to carriage 50 and a telescopic arm 56 that is carried by and moves along track 54. A ladle support rod 58 is pivotally attached to telescopic arm 56 and a ladle 60 is in turn pivotally attached to ladle support rod 58. Ladle 60 defines opposite top and bottom ends 62, 64, a hollow main body 66 and a mouth opening 68 at its top end 62. Mouth opening 68 defines a pouring spout 69 where molten metal will pour out of ladle 68 and a filling edge opening 71 wherein liquid metal will flow into ladle 68 to fill it when ladle 68 is dipped in molten metal.

Ladle 60 may consequently be moved towards and away from carriage 50 by moving telescoping arm 56 along track 54. Furthermore, ladle 60 may be inclined either by pivoting ladle 60 relative to ladle support rod 58 (see FIG. 2 where ladle 60 is thusly tilted in alternate positions shown in dotted lines) and/or by pivoting ladle support rod 58 relative to telescopic arm 56. Computer 37 controls robotic arm 48 and consequently the position and inclination of ladle 60 and may be linked to robotic arm 48 through any suitable communication means, such as wired or wireless communication means.

FIGS. 1 and 3-6 show that molding section 32 comprises first and second platens 72, 74 each holding respective first and second mold portions 76, 78. More than one first mold portion 76 and more than one second mold portion 78 could be installed on first and second platens 72, 74. First and second platens 72, 74 are mounted to a base 80 in a manner described hereinafter (i.e. they are mounted to base 80 by means of some intervening structures), and are movable relative to one another along a longitudinal axis L between an open position (FIGS. 3 and 4) in which first and second mold portions 76, 78 are spaced apart and a closed position (FIGS. 5 and 6) in which said first and second mold portions are pressed against each other along a parting line to form a mold 82.

Figure 7:
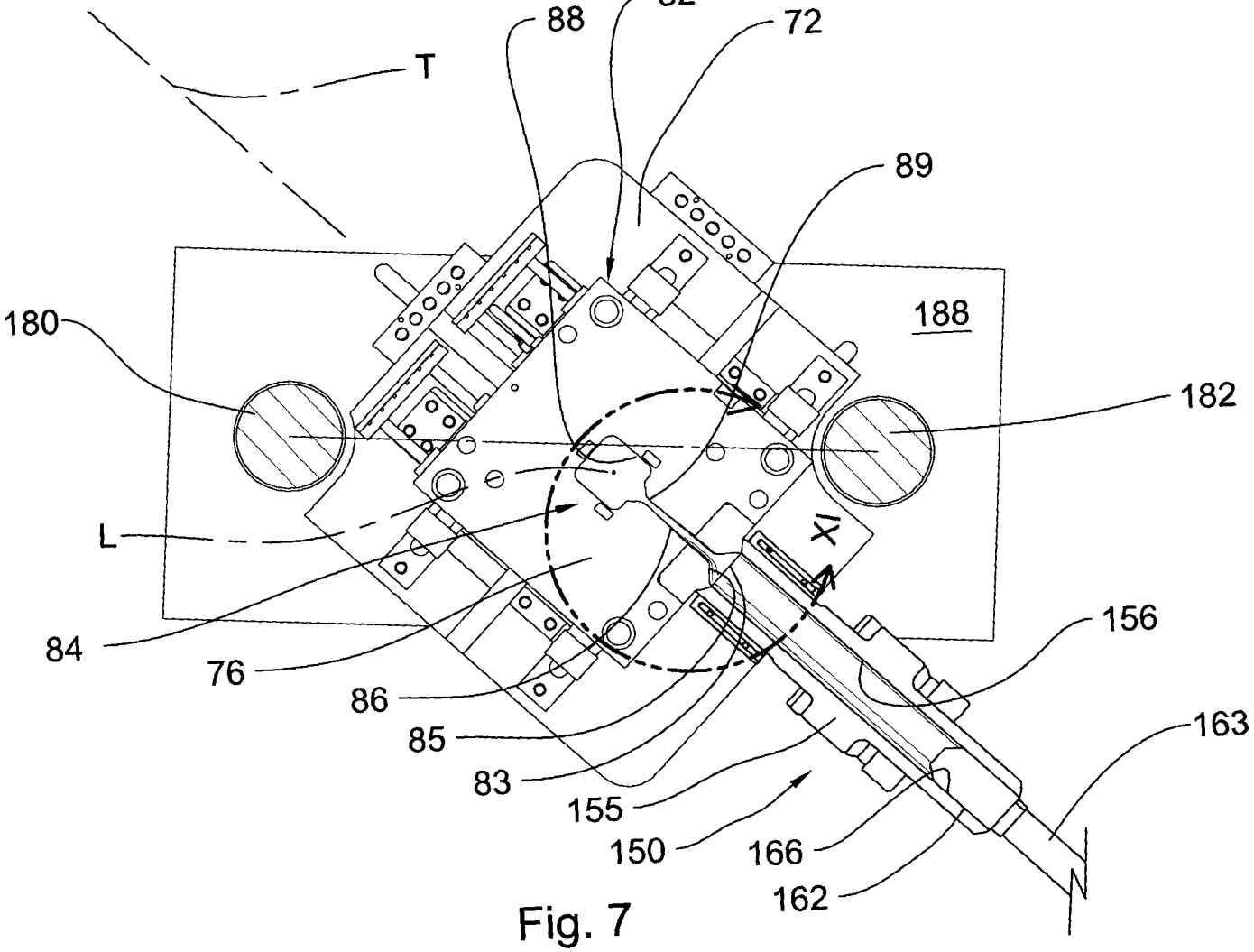
FIG. 7 is an enlarged cross-sectional side elevation taken at the parting line between the mold portions, showing a mold portion, a platen, a tie bar support plate, two tie bars and part of the injection sleeve of the die casting machine of FIG. 1, with the injection sleeve and platens being in their injection position.

FIG. 7 shows that a mold cavity 84 is formed between and enclosed by first and second mold portions 76, 78 when first and second platens 72, 74 are in their closed position, with the parting line extending within mold cavity 84. An inlet opening 83 is formed on mold 82 at its parting line and allows access into mold cavity 84 when platens 72, 74 are in their closed position for injecting liquid metal into mold cavity 84. Mold cavity 84 defines an inlet opening 83 leading into a biscuit cavity 85, a runner 86 and an article cavity 88 where liquid metal will harden to mold the metallic article. A gate 89 leads from runner 86 into article cavity 88. The configuration of mold cavity 84 will vary depending on the type of article being molded and the type of metal being used; and it will be obvious for someone skilled in the art of the present invention to substitute mold portions 76, 78 for other mold portions to accommodate specific molding requirements. However, any mold portion must obviously include an inlet opening 83 for metal injection and an inner cavity 84 wherein liquid metal will be poured. Inner cavity 84 may include a single article cavity 88 or a plurality (not shown) of article cavities 88 all linked to inlet opening 83 for being filled with metal.

Biscuit cavity 85 is shown in FIG. 7 to be of a generally conical shape. This is one advantage of the present invention over prior art die casting machines. The conical shape of biscuit cavity 85 will favor a low-turbulence inflow of liquid metal towards runner 86 and, more importantly, will accommodate a convex conical piston head that may protrude within biscuit cavity 85 as described hereinafter.

Figure 3:
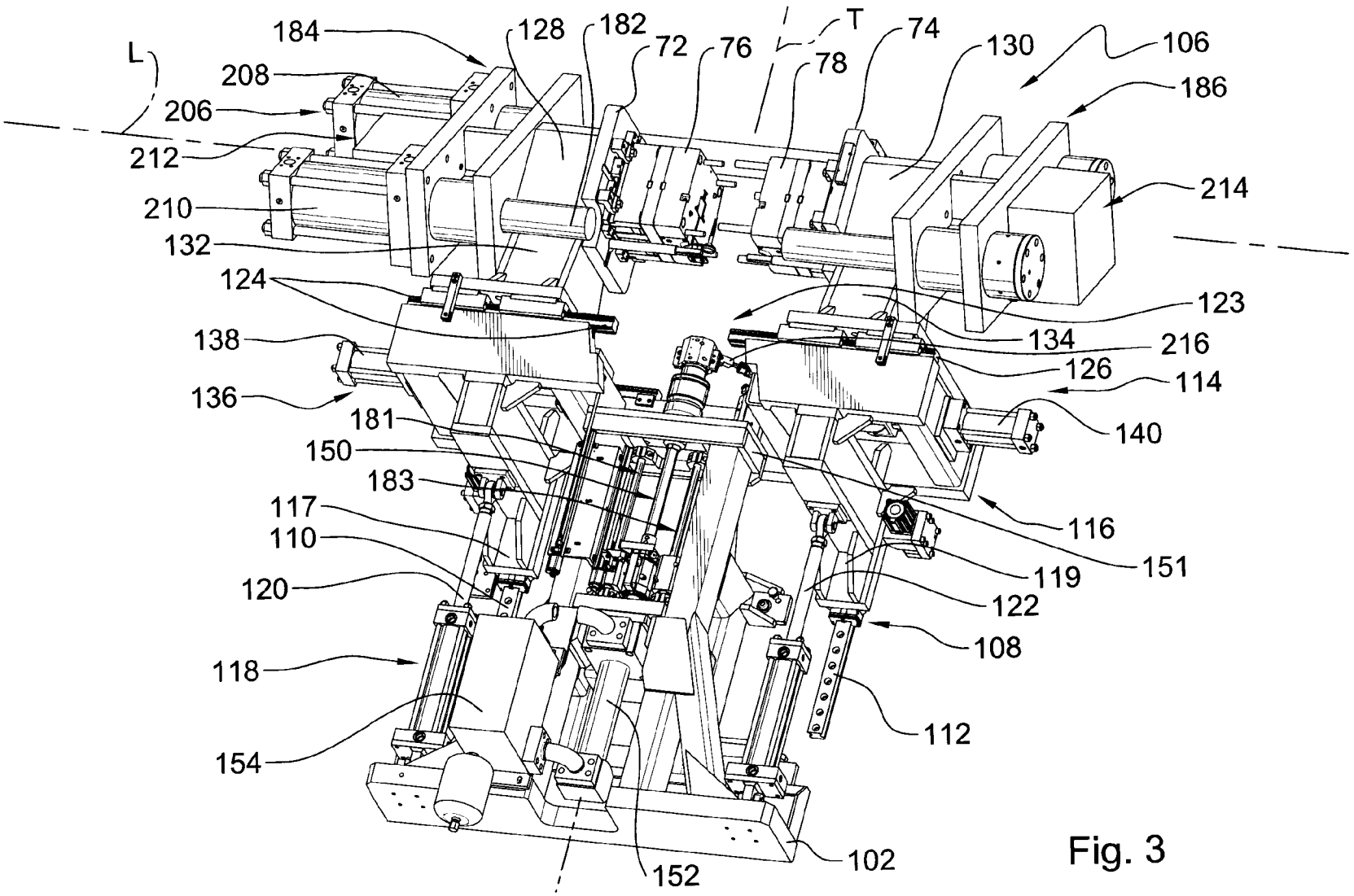
FIG. 3 is a perspective view of the platens, the mold, the mold closing pressure inducing mechanism, the injection sleeve, the transverse and longitudinal actuators and part of the base of the die casting machine of FIG. 1.
Figure 4:
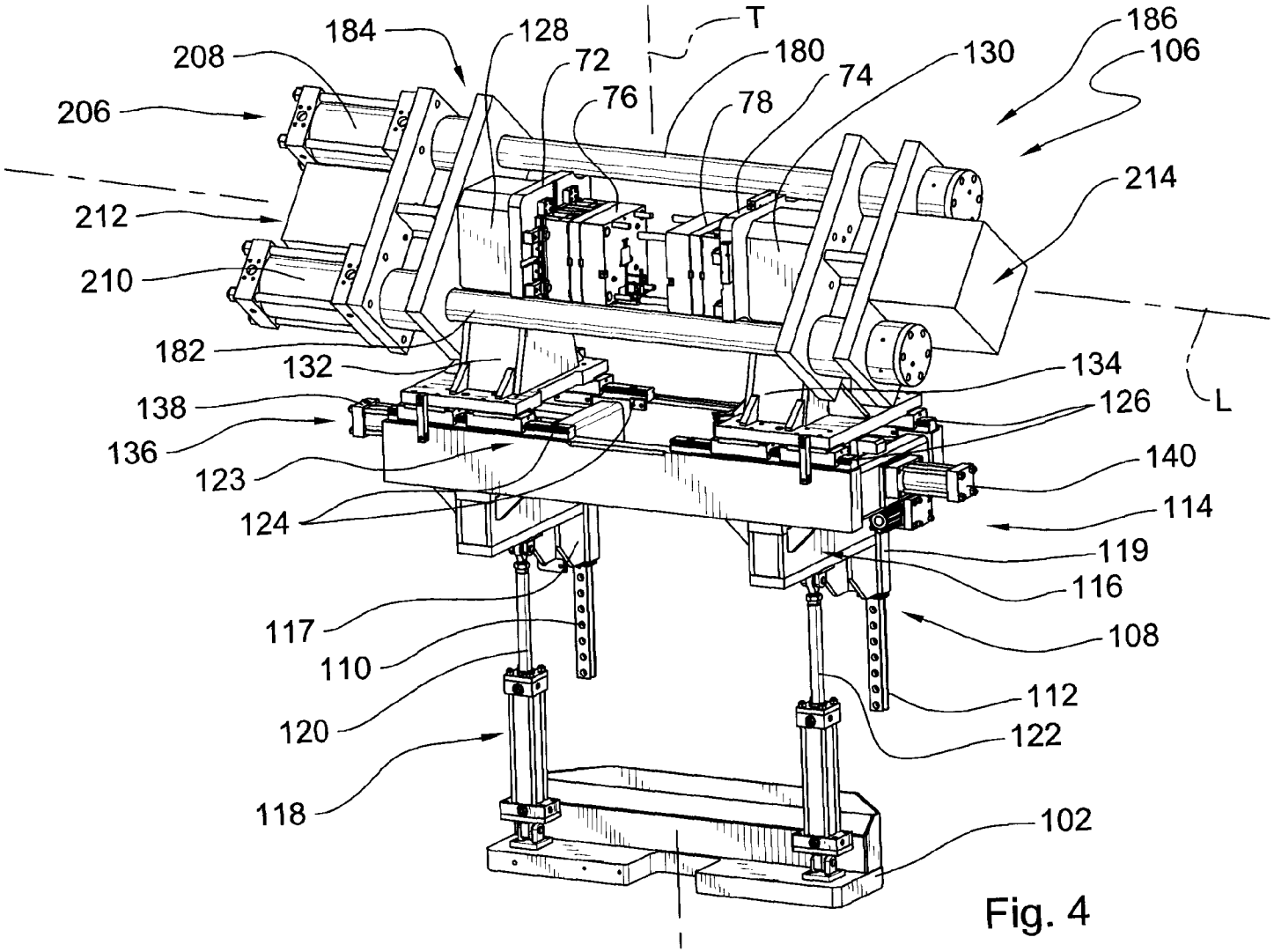
FIG. 4 is a perspective view at a slightly different angle than that of FIG. 3 of the platens, the mold, the mold closing pressure inducing mechanism, the transverse and longitudinal actuators and part of the base of the die casting machine of FIG. 1.
Figure 5:
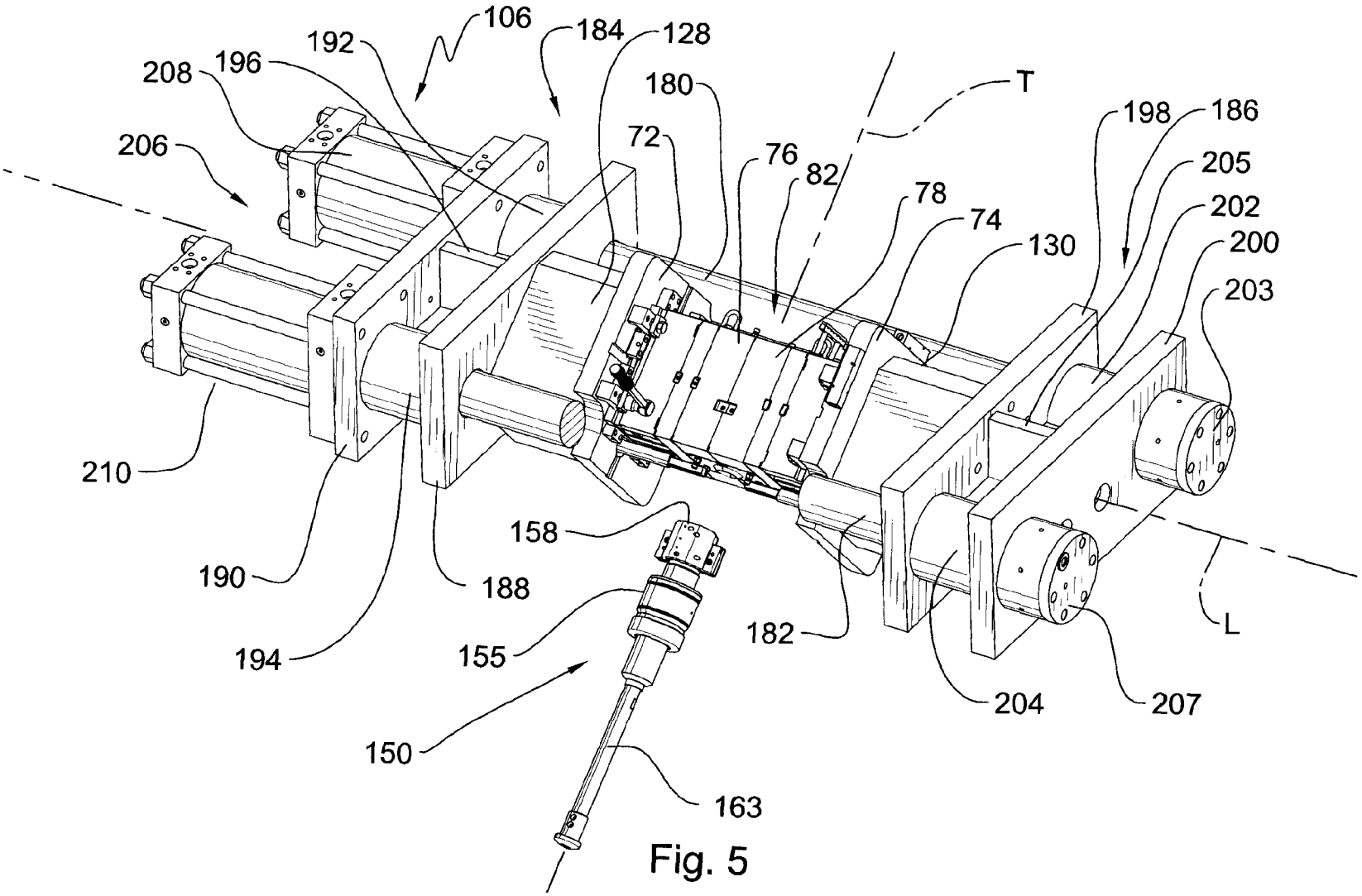
FIG. 5 is a perspective view of the platens, the mold, the mold closing pressure inducing mechanism and part of the injection sleeve of the die casting machine of FIG. 1, with the platens and mold portions being in their closed position and with the frontmost tie bar being partly broken for showing the structures located behind it.

As shown in FIGS. 1, 3 and 4 (although partly concealed in FIG. 1 and only partly shown in FIG. 3), base 80 comprises ground-resting bars 90 that rest on or are bolted to the ground, upright posts 92 that rest on or are bolted to the ground and that are fixed to respective ground resting bars 90, inclined support bars 94 that rest on or are bolted to the ground and that are fixed to and extend in inclined fashion between respective ground-resting bars 90 and upright posts 92, reinforcement trusses 96 that are fixed to and extend between respective ground-resting bars 90, upright posts 92 and inclined support bars 94, reinforcement crossbars 98 that are fixed to and extend between the ground-resting bars 90 and a lower support crossbar 100 that is fixed to and extends between the inclined support bars 94 near their lower end. A hydraulic cylinder seat 102 is fixedly attached to bottom support crossbar 100.

FIGS. 1 and 3-6 show that die casting machine 30 further comprises a mold closing actuator 106 capable of selectively inducing a closing pressure on first and second platens 72, 74 for forcing first and second platens 72, 74 towards their closed position.

More particularly, first and second platens 72, 74 are mounted to base 80 by means of a transverse track member 108 that includes first and second inclined tracks 110, 112 that are fixed along respective inclined supports 94. Tracks 110, 112 in turn carry a longitudinal track member 114 mounted to a transversal carriage 116 that is movable along tracks 110, 112. Transversal carriage 116 is hollow at its center and carries track-engaging members 117, 119 that engage inclined tracks 110, 112. A pair of hydraulic cylinders 120, 122 that form a transverse actuator 118 are seated against hydraulic cylinder seat 102 and attached underneath transversal carriage 116 to move transversal carriage 116 up and down along inclined tracks 110, 112 along a transversal axis T.

A longitudinal track member 123, in the form of longitudinal tracks 124, 126, is installed atop carriage 116 and is parallel to longitudinal axis L. Platens 72, 74 comprise backrests 128, 130 that are supported by longitudinal carriages 132, 134 that in turn engage longitudinal tracks 124, 126. A pair of hydraulic cylinders 138, 140, that form a longitudinal actuator 136, are installed on transverse carriage 116 to move platens 72, 74 along tracks 124, 126 and consequently along longitudinal axis L.

Computer 37 is linked to longitudinal and transversal actuators 136, 118 through any suitable communication means, such as wired or wireless communication means, to control actuators 136, 118.

Die casting machine 30 also comprises an injection mechanism 150 having an injection sleeve 155 mounted to base 80 and more particularly to U-shaped injection sleeve support 151 (FIG. 3). Within the present specification, the expression "injection sleeve" will be considered to include shot sleeves as typically used in cold chamber die casting machines.

Injection mechanism also comprises an injector in the form of a plunger 160 carried by a hydraulic cylinder 152. Hydraulic power means 154 of known construction are operatively connected to hydraulic cylinder 152 under the control of computer 37 to control the displacement of plunger 160. Computer 37 is linked to hydraulic power means 154 through any suitable communication means, such as wired or wireless communication means.

Figure 8:
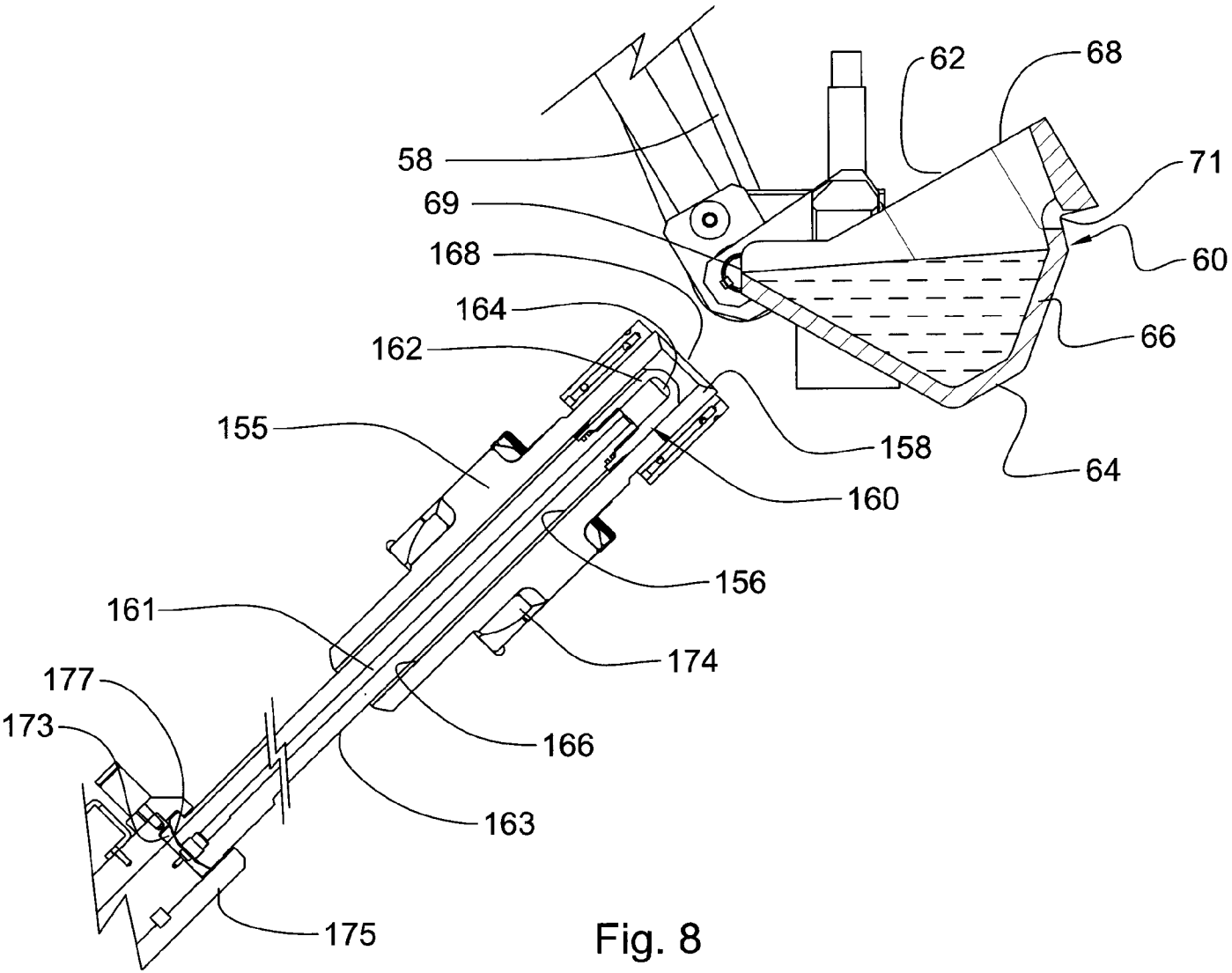
FIGS. 8-10 are enlarged cross-sectional side elevations of the top portion of the injection sleeve and the bottom portion of the robotic arm, including the ladle, of the die casting machine of FIG. 1, sequentially showing the filling operation of the injection sleeve inner chamber with liquid metal.
Figure 9:
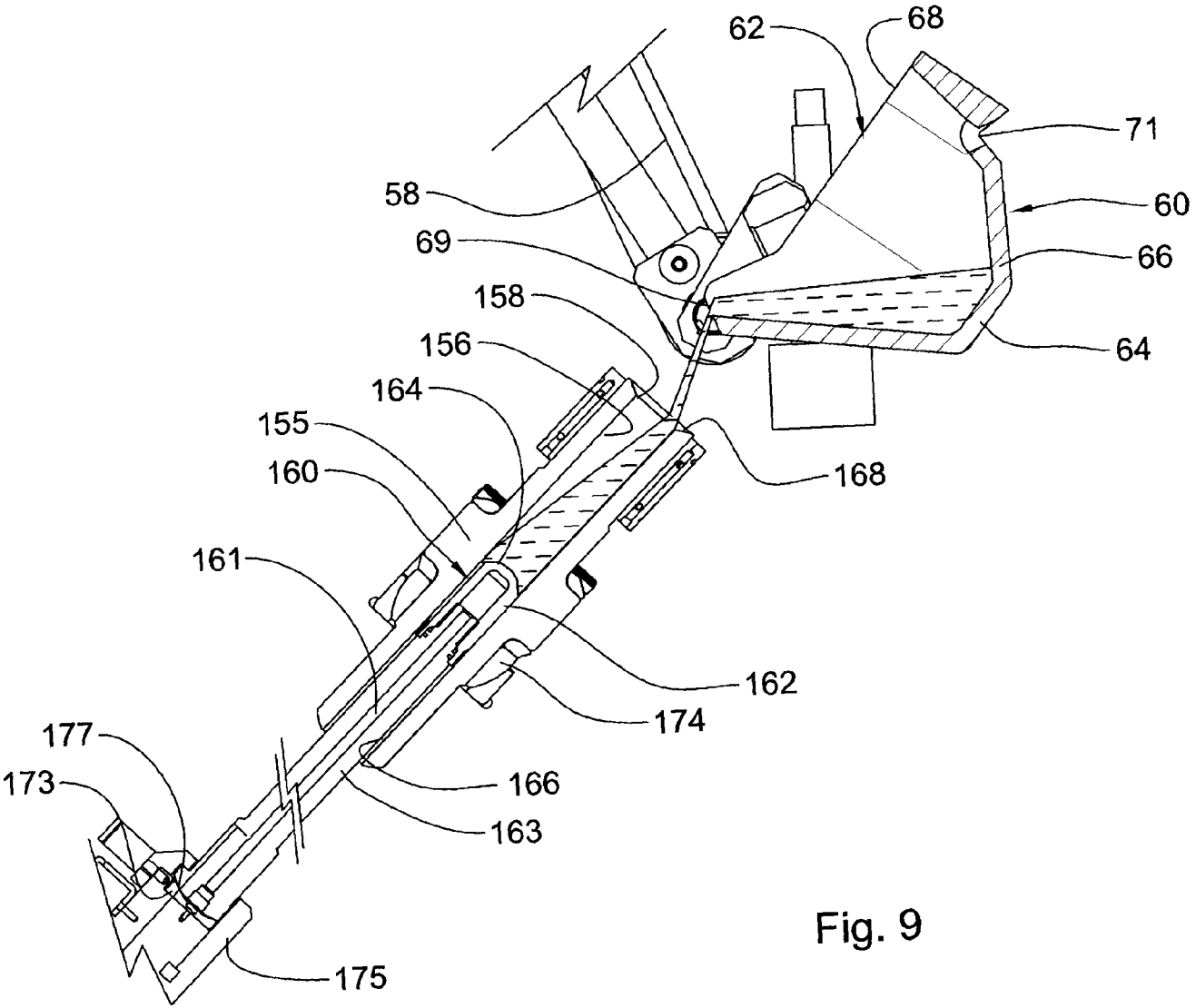
Figure 10:
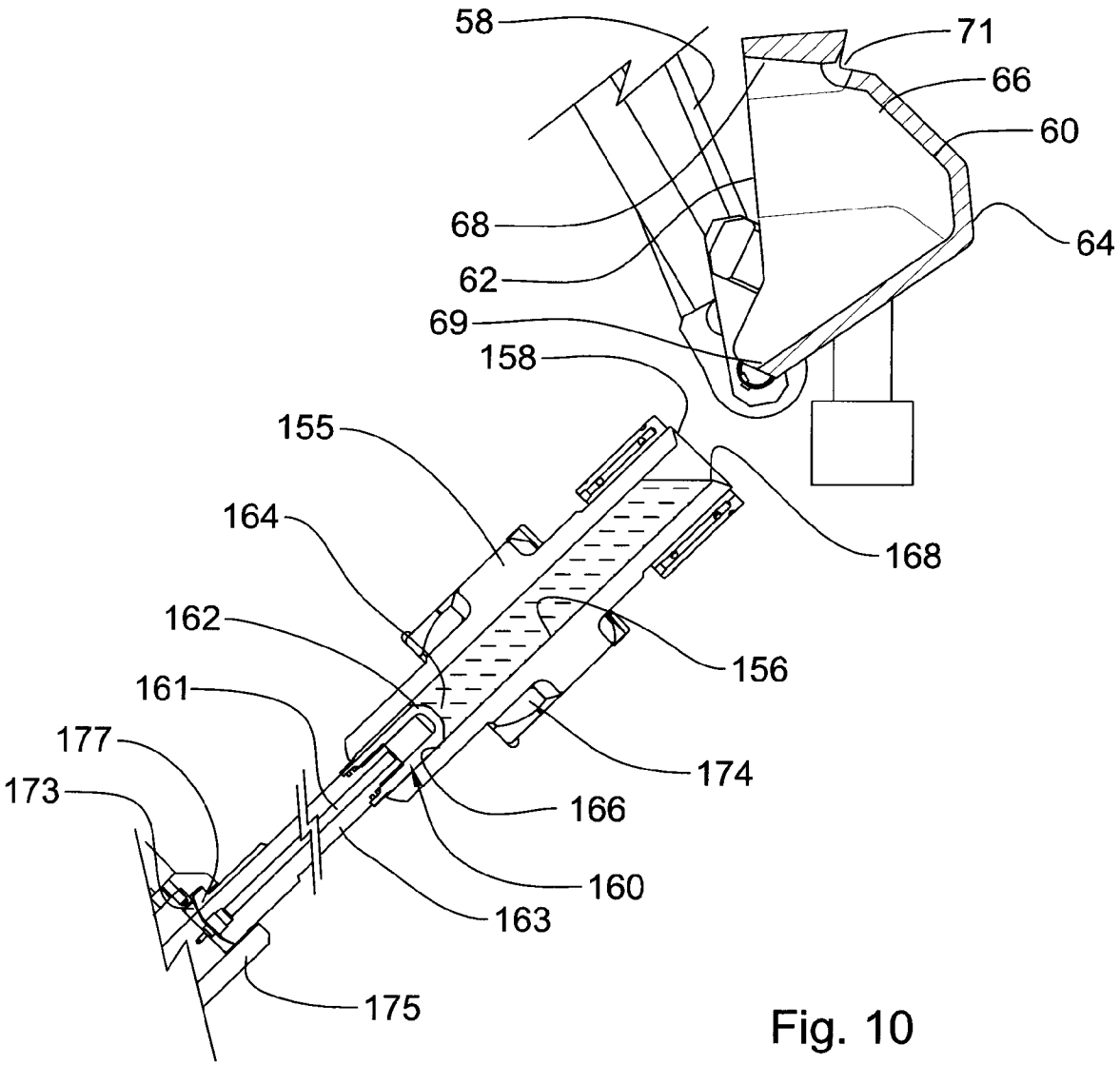

Injection sleeve 155, which is further shown in FIGS. 8-10, comprises an inner chamber 156 and a liquid metal injection port 158. Plunger 160 is movable within inner chamber 156 for forcing liquid metal from inner chamber 156 out through liquid metal injection port 158. Plunger 160 comprises a plunger head 162 located within inner chamber 156 and a plunger rod 163 linked to head 162, with plunger head 162 having a leading surface 164 of any suitable shape, such as a convex surface as shown in FIGS. 8-10. As suggested hereinabove, the convex generally conical leading surface 164 of plunger head 162 is complementary to the generally conical biscuit cavity 85. Plunger rod 163 may comprise hollow central channels 161 for cooling fluid and/or lubricant to circulate therein.

As further detailed hereinafter, injection sleeve 155 is movable relative to mold 82 between a distal position in which liquid metal injection port 158 and mold inlet opening 83 are spaced apart; and an injection position in which injection sleeve 155 engages mold 82 at inlet opening 83 when first and second platens 72, 74 are in their closed position, with liquid metal injection port 158 then being in liquid communication with inlet opening 83 for allowing liquid metal to be injected from injection sleeve inner chamber 156 into mold cavity 84. Inner chamber 156 is elongated and defines opposite first and second ends 166, 168 with liquid metal injection port 158 being located at the inner chamber second end 168 and with the plunger head 162 having a determined range of movement within inner chamber 156 between first and second ends 166, 168 as detailed hereinafter. Injection sleeve 155 extends through the hollow center portion of transversal carriage 116, with the latter being movable about injection sleeve as it moves up and down along transversal track member 108.

Figure 11:
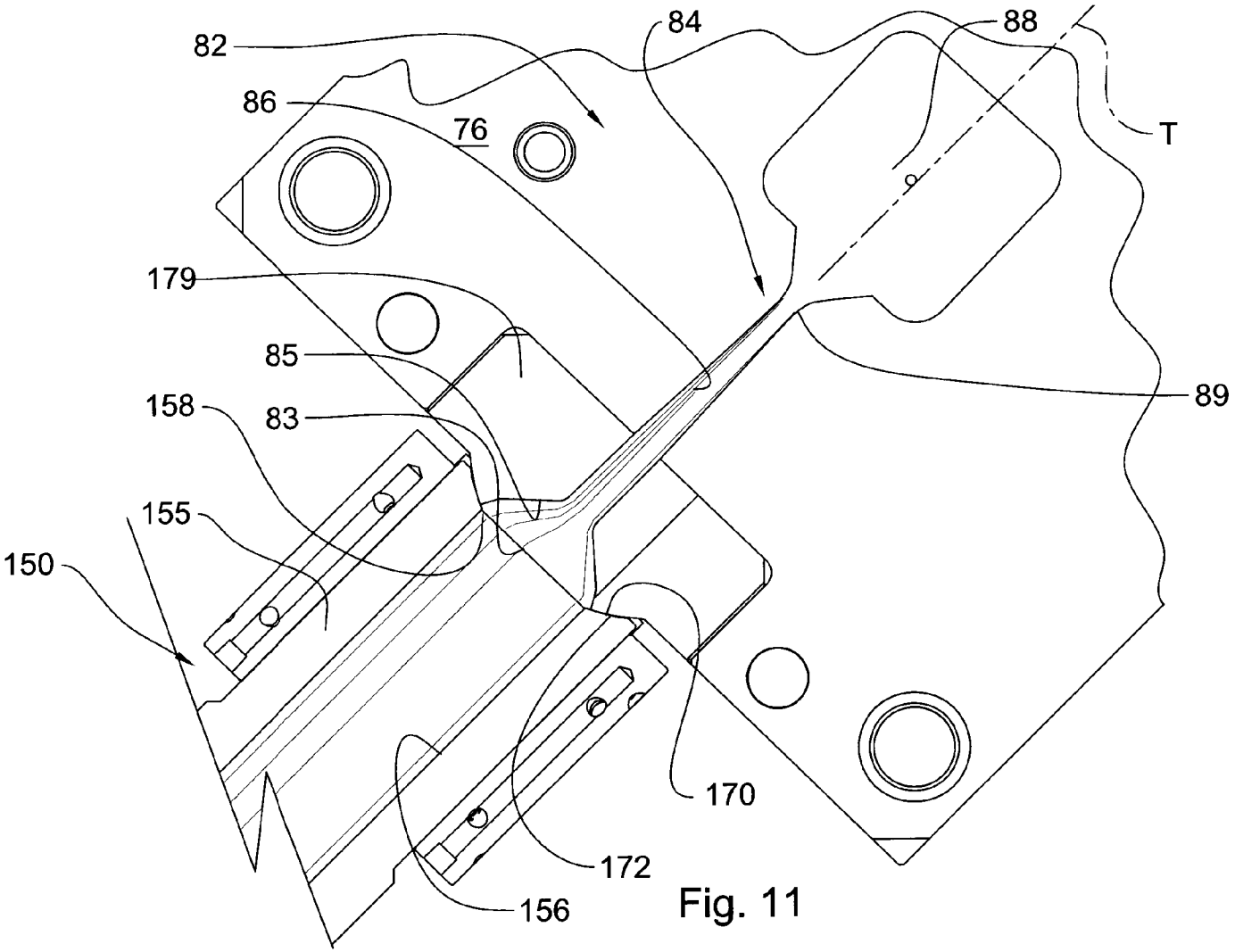
FIG. 11 is an enlarged cross-sectional side elevation of area XI of FIG. 7.

To ensure a suitable sealing engagement between injection sleeve 155 and mold 82, and as shown in FIG. 11, injection sleeve 155 is provided with a female interface member 170 at inner chamber second end 168 and mold 82 is provided with a complementary male interface member 172 on its outer surface at inlet opening 83. More particularly, male interface member 172 comprises two semi-annular protrusions each on a corresponding mold portion 76 or 78 that form an annular protrusion on the mold outer surface around inlet opening 82 when mold portions 76, 78 are joined in their closed position. Male interface member 172 comprises an annular convex outer surface and female interface member 170 comprises an annular concave outer surface engageable against the annular convex outer surface of male interface member 172 to create a male-female engagement seal.

In one embodiment, the annular convex outer surface of male interface member 172 has a radius of curvature which is smaller than the radius of curvature of the annular concave outer surface of female interface member 170 at the point of contact between the male and female interface members 172, 170 when the male-female engagement seal is created, for providing a substantially linear circular contact between male and female interface members 172, 170. If both the male and female interface members 172, 170 had a same radius of curvature, then an annular, non-linear contact area would exist between male and female interface members 172, 170 that would be likely to be less fluid-tight than a linear contact is, due to the force between the injection sleeve 155 and the mold 82 being distributed over a larger area in the case of a non-linear contact area. Also, in the case of a non-linear contact area, it is more likely that the pressure between the injection sleeve 155 and the mold 82 will be distributed unevenly. Consequently, having a substantially linear contact at male-female interface members 172, 170 is advantageous.

According to an alternate embodiment (not shown), the female interface member could be provided on the mold and the male interface member could be provided on the injection sleeve. Generally, a first male-female interface member that comprises either one of a male or a female interface member is provided on injection sleeve 155 at liquid metal injection port 158 and a second male-female interface member that comprises the other one of a male or a female interface member is provided on said mold at inlet opening 83, with the first and second male-female interface members being complementary to form a male-female engagement seal between injection sleeve 155 and mold 82 when injection sleeve 155 is in its injection position.

However, the sealing arrangement wherein mold 82 is provided with the male interface member 172 that is engaged by the female interface member 170 of injection sleeve 155 will advantageously promote that the first and second mold portions 76, 78 remain closed when liquid metal is being injected into mold cavity 84. This arrangement is consequently preferred.

Injection sleeve 155 is mounted to injection sleeve support 151 of base 80 by means of a pivotal joint in the form of a spherical bearing 174 (FIGS. 8-10) so as to be pivotable about an injection sleeve reference axis. Spherical bearing 174 comprises an injection sleeve biasing member, for example spherical bearing 174 may comprise a resilient ring to continuously bias injection sleeve 155 towards its above-mentioned injection sleeve reference axis. The injection sleeve reference axis preferably coincides with transversal axis T.

Plunger rod 163 is mounted to hydraulic cylinder 152 by means of a coupling member 175 (FIGS. 8-10) that has a disc 173 with a concave plunger-receiving surface to which the complementary convex bottom end 177 of the plunger rod 163 is pivotally attached. Plunger rod is consequently allowed to pivot in this concave seat to follow any displacement of injection sleeve 155 while its displacement along the injection sleeve reference axis is provoked by hydraulic cylinder 152.

A linear guide member in the form of a pair of linear bearing and shaft assemblies 181, 183 (FIG. 3) that are fixed to base 80 and operatively coupled to coupling member 175 guide coupling member 175 and plunger rod 163 in their linear displacement under the extraction and retraction of hydraulic cylinder 152. Linear bearing and shaft assemblies 181, 183 help prevent wear of plunger head 162, injection sleeve 155 and the piston of hydraulic cylinder 152.

A runner insert 179 (FIG. 11) is preferably (although optionally) provided on mold 76, 78. Runner insert 179 is made of two half portions (only one being seen in FIG. 11) in which inlet opening 83, biscuit cavity 85 and part of runner 86 are made. Runner insert 179 is made from a material that is slightly softer than that of injection sleeve 155 so that it is runner insert 179 that will wear over time. Runner insert 179 is replaceable once worn.

As mentioned hereinabove, mold closing actuator 106 is capable of inducing a closing pressure on platens 72, 74 to force them towards their closed position. More particularly, this closing pressure will be induced once platens 72, 74 are already in their closed position and will act to maintain platens 72, 74 in their closed position against pressure exerted internally in mold 82 during liquid metal injection in mold 82. Longitudinal actuator 136 will effectively move platens 72, 74 between their opened and closed positions, while mold closing actuator 106 will induce a high-pressure force on platens 72, 74 to ensure that they do not separate during molding operations, as detailed hereinafter.

Mold closing actuator 106 comprises a number of tie bars, for example two tie bars 180, 182 as shown in FIGS. 1 and 3-6, that are parallel to longitudinal axis L and linked to first and second platens 72, 74 by means of tie bar support members 184, 186. Tie bar support members 184, 186 are more resilient than platens 72, 74 and are allowed to slightly resiliently deform when the closing pressure is applied to first and second platens 72, 74 via tie bar support members 184, 186 and tie bars 180, 182. This deformation is suggested in dotted lines in FIG. 6, although this deformation is exaggerated in FIG. 6 for illustrative purposes, in reality the deformation is not as important as that shown in FIG. 6.

First tie bar support member 184 comprises a pair of spaced-apart first tie bar support plates 188, 190, with first and second tie bars 180, 182 each extending through both first tie bar support plates 188, 190 and through respective hollow cylindrical tie bar sleeves 192, 194 that are fixed between and space apart first tie bar support plates 188, 190. First tie bar support member 184 further comprises a first web 196 linking and spacing first tie bar support plates 188, 190 in-between sleeves 192, 194.

Second tie bar support member 186 comprises a pair of spaced-apart second tie bar support plates 198, 200, with first and second tie bars 180, 182 each extending through both second tie bar support plates 198, 200 and through respective tie bar sleeves 202, 204 that are fixed between and space apart second tie bars support plates 198, 200. Second tie bar support member 186 further comprises a second web 205 also linking and spacing second tie bar support plates 198, 200 in-between sleeves 202, 204.

First tie bar support member 184 is elongated and defines opposite end portions that protrude beyond the peripheral edge of first platen 72, and second tie bar support member 186 is elongated and defines opposite end portions that protrude beyond the peripheral edge of second platen 74. That is to say, first and second tie bar support members 184, 186 are wider than first and second platens 72, 74. First tie bar 180 engages registering end portions of first and second tie bar support members 184, 186 and second tie bar 182 engages registering end portions of first and second tie bar support members 184, 186 to allow first and second tie bars to extend exteriorly of the periphery of first and second platens 72, 74, spaced therefrom, to avoid any friction or contact between platens 72, 74 and tie bars 180, 182 when platens 72, 74 move between their opened and closed positions.

First and second tie bars 180, 182 are fixed at a first end thereof to a respective tie bar socket 203, 207 located exteriorly of second tie bar support member 186.

Mold closing actuator 106 further comprises a mold closing pressure inducing mechanism 206 capable of inducing the above-mentioned closing pressure on first and second platens 72, 74. This closing pressure is induced by means of first and second high-pressure hydraulic cylinders 208, 210 via tie bars 180, 182 for forcing first and second platens 72, 74 towards their closed position. First and second tie bars 180, 182 in fact directly extend into first and second high-pressure hydraulic cylinders 208, 210 to form the cylinder rods thereof, although alternately first and second tie bars 180, 182 could be operatively coupled to distinct cylinder rods of first and second high-pressure hydraulic cylinders 208, 210. In any event, since first and second tie bars 180, 182 are fixed to sockets 203, 207 at their first end as mentioned above, when high-pressure hydraulic cylinders 208, 210 are retracted, the closing pressure is transferred to platens 72, 74 via tie bar support members 184, 186 and tie bars 180, 182; while the closing pressure is released when high-pressure hydraulic cylinders are extracted.

Computer 37 controls high-pressure hydraulic cylinders 208, 210 and is linked to them through any suitable communication means, such as wired or wireless communication means.

As will be obvious for someone skilled in the art by now, die casting machine 30 as shown in the drawings is a cold chamber die casting machine wherein the liquid metal port 158 and inner chamber 156 of injection sleeve 155 and the inlet opening 83 of mold 82 are generally of a same cross-sectional dimension for allowing formation of a biscuit after the liquid metal has been injected into mold cavity 84.

In use, die casting machine 30 is controlled through computer 37 for molding metallic articles, although it is understood that other automated and also some partly manual control mechanisms could be used instead of computer 37. To mold a metallic article, ladle 60 is first filled with liquid metal at furnace 34. To accomplish this, robotic arm 48 is moved along rail member 42 until robotic arm 48 is properly aligned over the furnace opening 39. Telescopic arm 56 is then lowered along track 54 until ladle 60 is at least partly submerged into liquid metal. A system for detecting the level of liquid metal in the crucible of furnace 34 may be provided for allowing the ladle to be lowered accordingly. The inclination of ladle 60 may be suitably adjusted before and during the insertion of ladle 60 into the liquid metal to optimise the filling operation. More particularly, ladle 60 may be tilted while it is partly inserted into the molten metal to have the molten metal flow into its hollow main body 66 over filling edge portion 71 of mouth opening 68. Once ladle is suitably filled with the proper quantity of liquid metal, ladle 60 is tilted back to a horizontal position and telescopic arm 56 is lifted to retrieve the now-filled ladle 60 from the crucible of furnace 34.

The liquid molten metal is then carried in ladle 60 in a conveyance direction D (FIG. 2) along rail member 42 from furnace 34 to injection sleeve 155 where ladle 60 will be used to pour the liquid metal into injection sleeve inner chamber 156. Conveyance direction D is the direction that leads from furnace 34 to injection sleeve 155. According to the present invention, the method for carrying the liquid metal comprises the steps of:

- accelerating robotic arm 48, and consequently ladle 60, away from furnace 34 as ladle 60 leaves furnace 34;
- decelerating ladle 60 as it approaches injection sleeve 155; and
- while ladle 60 accelerates and decelerates, tilting ladle 60 to maintain a same relative position of the liquid metal within ladle 60.

Figure 2:
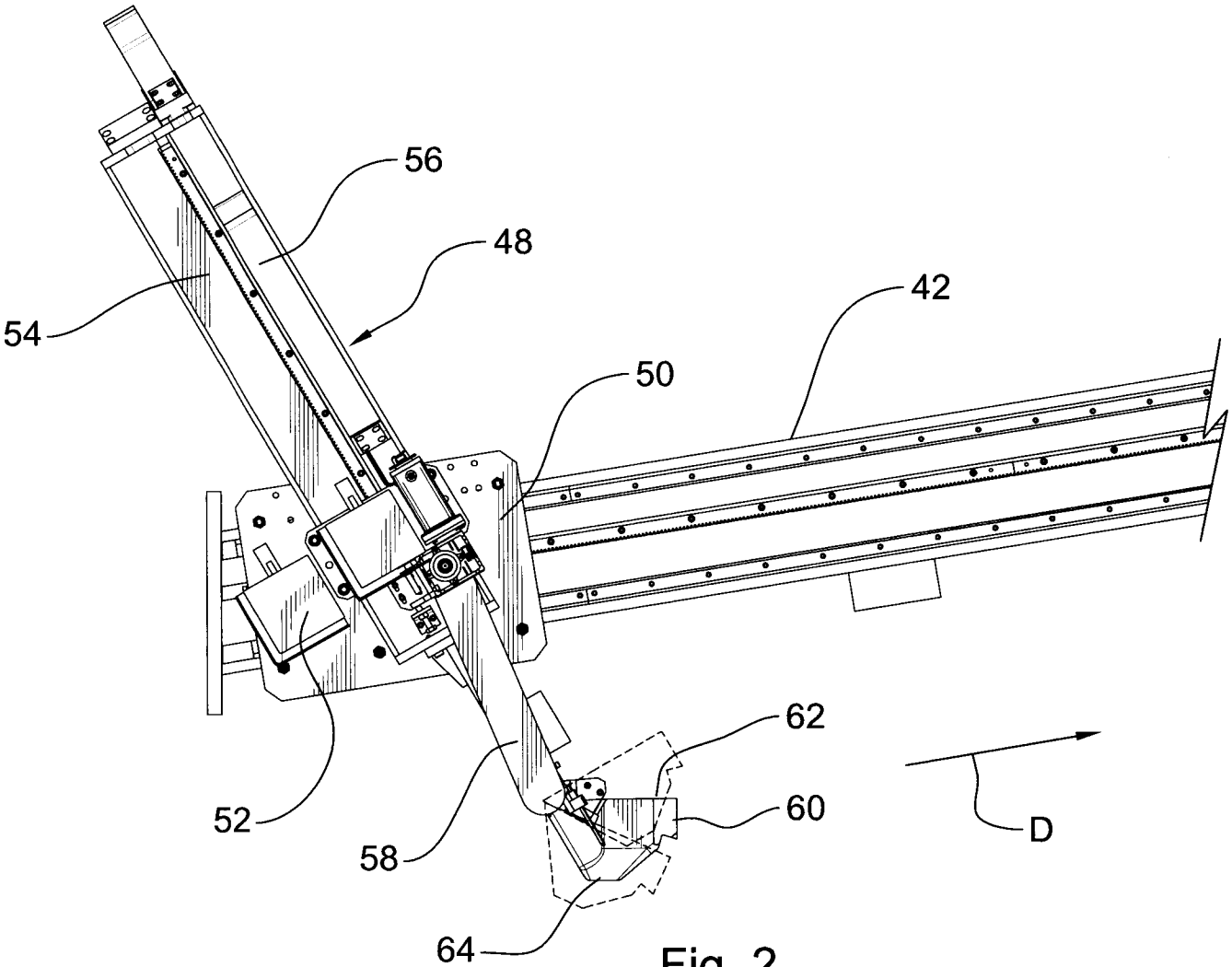
FIG. 2 is an enlarged side elevation of the robotic arm and part of the rail member that supports it of the die casting machine of FIG. 1.

More particularly, as suggested in FIG. 2, the step of tilting ladle 60 to maintain a same relative position of the liquid metal within ladle 60 comprises tilting ladle 60 so that mouth opening 68 will face at least partly in said conveyance direction when ladle 60 accelerates and will face partly away from said conveyance direction when ladle 60 decelerates.

This is advantageous in that it will reduce turbulence of the liquid metal in ladle 60 and is likely to consequently reduce the likelihood of undesirable bubbles appearing in the liquid metal during the conveyance towards the injection sleeve 155. It will also help prevent accidental spilling of liquid metal out of ladle 60 during high-speed transportation.

When ladle 60 reaches a position above injection sleeve 155, the filling of injection sleeve 155 may commence. First, ladle 60 will be positioned adjacent to the liquid metal port 158 of injection sleeve 155, in a position resembling that of FIG. 8. Then, according to the present invention, the method of filling injection sleeve 155 and then ejecting liquid metal from injection sleeve 155 comprises:

- positioning piston head 162 at a starting position located away from inner chamber first end 166 towards said inner chamber second end 168. The starting position could but need not correspond to the inner chamber second end 168, it could be located anywhere along inner chamber 156 away from first end 166 to give it room for later retraction towards first end 166;
- pouring liquid metal into inner chamber 156 through liquid metal port 158. All liquid metal poured into inner chamber 156 will of course remain over piston head 162. The liquid metal is poured from ladle 60 through its spout 69 although in alternate embodiments the ladle mouth opening 68 could be symmetrical and any point at its periphery could be used to pour the liquid metal;
- retracting piston head 162 from its starting position towards inner chamber first end 166 while the liquid metal is being poured into inner chamber 156. This is sequentially suggested in FIGS. 8-10. The purpose behind retracting the piston head 162 during the filling operation is to minimize turbulence and air bubble formation in the liquid metal; and
- ejecting the liquid metal from inner chamber 156 by moving piston head 162 towards inner chamber second end 168.

These steps will be cyclically repeated for filling the injection sleeve repeatedly, each filling corresponding to one liquid metal injection shot.

The starting position of piston head 162 can be located substantially at the inner chamber second end 168. This means either at the inner chamber second end 168, or slightly retracted into or even out of inner chamber 156, but near second end 168. Alternately, the starting position of piston head 162 can be spaced away from inner chamber second end 168 towards inner chamber first end 166, for example one quarter, one half or three quarters of the way into inner chamber 156, as long as there remains enough spaced for piston head 162 to be retracted further while the liquid metal is being poured.

During the liquid metal ejection, piston head 162 may reach inner chamber second end 168, extend slightly out of inner chamber second end 168 or remain within inner chamber second end 168 (in the latter case, formation of a biscuit may occur partly within inner chamber 156).

After having poured the liquid metal into inner chamber 156 but before ejecting the liquid metal out of inner chamber 156, it is possible to move piston head 162 to a pre-ejection position located away from its retracted position to exhaust air from the liquid metal before it is ejected from inner chamber 156. This movement may be done at slow speed to promote air exhaust without causing significant turbulence in the liquid metal present in inner chamber 156. This movement may be accomplished either towards from inner chamber second end 168 or even away from inner chamber second end 168—in the latter case if some leeway exists between the liquid metal and the inner chamber mouth opening 158 to avoid spilling liquid metal. This air exhaust may be accomplished either before injection sleeve 155 engages mold portions 76, 78 or even after—in the latter case the air will be exhausted through the mold vents that are conventionally used to exhaust air from within the mold.

According to the present invention, the method of molding a metallic article with die casting machine 30 comprises:

filling at least partly injection sleeve inner chamber 156 with liquid metal. This filling operation can be accomplished as described above with retraction of the piston head 162 while the liquid metal flows into the injection sleeve inner chamber 156, or in a more traditional way by simply positioning the piston head 162 at a desired position and then filling the inner chamber 156;

relatively moving first and second platens 72, 74 into their closed position wherein the mold portions 76, 78 will abut each other at the parting line. According to the embodiment shown in the annexed drawings, this is accomplished with longitudinal actuator 136 moving platens 72, 74 but it could alternately be accomplished otherwise, including by using a closing linkage or by using the high pressure mold closing pressure inducing mechanism 206 to move platens 72, 74 in addition to it providing the high-pressure mold closing pressure. It is also noted that this relative movement can be accomplished by simultaneously moving both first and second platens 72, 74 towards each other as per the embodiment shown in the drawings or alternately by having one fixed platen and one movable platen that will move to engage the fixed platen;

relatively moving injection sleeve 155 and mold 82 between a distal position in which liquid metal injection port 158 and inlet opening 83 are spaced apart; and an injection position in which injection sleeve 155 engages mold 82 around inlet opening 83 and in which first and second male-female interface members 172, 170 engage each other to form an engagement seal between injection sleeve 155 and mold 82, with liquid metal injection port 158 then being in liquid communication with inlet opening 83. In the embodiment shown in the drawings, this relative movement is accomplished with transversal actuator 118 moving platens 72, 74 and mold 82 down towards injection sleeve 155 along transversal axis T, but any other suitable means to accomplish this relative movement would be acceptable, including by moving either one of injection sleeve 155, platens 72, 74 or both. It is noted that the relative movement of injection sleeve 155 and mold 82 may be accomplished simultaneously with the relative movement of first and second platens 72, 74 towards each other, as long as the latter reach their closed position before injection sleeve 155 and mold 82 engage each other. Also, although the male-female engagement is one advantageous way to carry out the invention, other suitable sealing engagements may also be used wherein the geometry of the interacting elements or their materials may be adapted to offer a suitable seal between the injection sleeve 155 and the mold 82. For example, a seal comprising a deformable O-ring or a seal wherein one of the injection sleeve 155 and the mold 82 is softer than the other to slightly elastically deform under pressure, could be used;

injecting liquid metal from injection sleeve inner chamber 156 into mold cavity 84 with injector 160, i.e. piston head 162 will be pushing the liquid metal out of inner chamber 156 to convey it through mold inlet opening 83;

allowing the liquid metal to cool and harden inside mold cavity 84 whereby the metallic article will be created. During the cooling operation, a biscuit will form in inlet opening 83 and possibly partly in injection sleeve inner chamber 156;

relatively moving injection sleeve 155 and mold 82 between their injection position and their distal position. The distal position refers to a position where injection sleeve 155 and mold 82 are spaced apart, it need not be moved to the same place after the molding operation as it was before the molding operation;

relatively moving first and second platens 72, 74 away from their closed position; and retrieving the metallic article from the mold. Ejecting mechanisms 212, 214 of known construction are provided on die casting machine 30, and more particular are fixed to first and second tie bar support members 184, 186, to facilitate this operation. It should be noted that in prior art cold chamber die casting machines where the injection sleeve was located on the backside of one of the platens, it was not possible to provide ejecting mechanisms on both platens whereas with the die casting machine of the present invention where the injection sleeve is located at the parting line, providing ejecting mechanisms on the backside of both platens becomes possible. The biscuit formed during the cooling operation may also be recuperated at this time, to be forwarded to the furnace so that the metal may be reused.

According to the present invention, a plunger lubrication device 216 (FIG. 3) that includes a movable lubrication nozzle is optionally attached to base 80 for lubricating the plunger head 162. Plunger lubrication device 216 comprises a pressurized lubricant reservoir and is controlled by computer 37 that cyclically moves the lubrication nozzle over the plunger head 162 to spray lubricant thereon.

One advantage of the present invention lies in the fact that the injection sleeve is separated from the mold itself and it may be filled through its liquid metal port 158 while an article is being molded within mold 82. Indeed, by having the injection sleeve 155 and mold 82 move away from each other after the liquid metal shot has been injected into mold 82, injection sleeve 155 is free to be filled with a new liquid metal shot while the previous metal shot is being cooled in mold 82 to form the article. This significantly decreases the total article molding cycle time compared to prior art devices wherein the new liquid metal shot was only poured into the injection sleeve once the article was completed and retrieved from the mold.

In the embodiment shown in the drawings, mold cavity 84 comprises a runner 86 that advantageously extends away from the mold inlet opening 83 in line with injection sleeve 155 when injection sleeve 155 and mold 82 are in their injection position. When liquid metal is injected from injection sleeve inner chamber 156 into mold cavity 84 with plunger 160, the liquid metal will consequently be injected in a straight line from injection sleeve 155 through runner 86. This is advantageous over prior art devices wherein the injection sleeve extends through the fixed platen and a 90° elbow exists between the injection sleeve and the runner that leads up to the article cavity which impedes the liquid metal flow, causing undesirable turbulence during injection, and requires extra injection pressure to feed the liquid metal into the prior art mold cavity.

Transverse track member 108 is fixedly supported on base 80 in an inclined fashion at an angle ranging between 1° and 90°, for example at 45°, relative to a horizontal plane so that platens 72, 74 will move down (at least in part) as they move towards injection sleeve 155 and up (at least in part) as they move away from injection sleeve 155. This movement is accomplished along transversal axis T. Moreover, injection sleeve 155 is also aligned with transversal axis T, which allows injection sleeve 155 to advantageously engage mold 82 orthogonally. The fact that injection sleeve 155 is mounted on a spherical bearing 174 allows it to compensate any very small irregularity in alignment when it engages mold 82: it will then pivot slightly to become evenly engaged at male-female interface members 172, 170. Plunger rod 163 will pivot correspondingly due to its pivotal attachment to coupling 175.

The injection sleeve 155 being inclined allows its liquid metal injection port 158 to be higher than its inner chamber 156, which allows inner chamber 156 to be filled without liquid metal spilling out of liquid metal injection port 158. It also allows a larger proportion of inner chamber 156 to be filled, as opposed to prior art horizontal injection sleeves wherein it was frequent for only a fraction of the injection sleeve to be filled, resulting in considerable undesirable air injection in mold cavity 84. The inclination of injection sleeve 155 also allows the pre-ejection position of the piston head 162 to be adjusted depending on the volume of the liquid metal shot, preventing the use of a single-purpose pre-ejection position that would then allow much more air to be injected into mold cavity 84 when liquid metal shots of smaller volume are being used.

It should be noted that, contrarily to prior art die casting methods, the step of injecting liquid metal from injection sleeve inner chamber 156 into mold cavity 84 with injector 160 does not require an intensification step at the end of the injection wherein the pressure applied by plunger 163 is increased. This is an unexpected and advantageous result over the prior art obtained because there is almost no air injected into the mold cavity due to the inclined disposition of the injection sleeve 155. As a consequence, the injection cycle time is reduced, the hydraulic system is simpler and wear of injection components is reduced due to lower injection pressures.

Mold closing actuator 106 comprises means for unevenly distributing the closing pressure on first and second platens 72, 74 for compensating a transverse injection sleeve contact pressure resulting from injection sleeve 155 engaging mold 82 at said injecting position. The purpose is to obtain a resulting effective molding pressure between first and second mold portions 76, 78 that will be substantially evenly distributed across the parting line. More particularly, FIG. 7 shows that tie bars 180, 182 are disposed asymmetrically relative to the center point of mold 82 where longitudinal axis L passes. This allows a considerable transverse injection sleeve contact pressure to be applied against mold 82 without the elongated mold-platen assembly undesirably curving under this transverse contact pressure. Having an important transverse injection sleeve contact pressure on mold 82 is in itself very desirable to help avoid liquid metal from leaking between injection sleeve 155 and mold 82 during injection, and to allow an increase in injection pressure and consequently an increase in article quality.

The present invention consequently comprises a method of applying pressure on first and second mold portions 76, 78 during the molding operation, with first and second platens 72, 74 being in their closed position and with injection sleeve 155 and platens 72, 74 being in their injection position, the method comprising concurrently applying:

a closing pressure on platens 72, 74 with mold closing actuator 106 wherein the closing pressure is unevenly distributed so as to compensate the transverse contact pressure to have a resulting effective molding pressure on mold portion 76, 78 that is substantially evenly distributed across the parting line; and a transverse contact pressure between platens 72, 74 and injection sleeve 155 with transverse actuator 118.

The expression "substantially evenly distributed" refers here to the fact that although the effective molding pressure distribution will be very well distributed, a precisely even effective molding pressure distribution is almost impossible to achieve in practice. For one thing, the pressure distribution will vary depending on the mold being used, the article being molded, the molding temperature and other operation parameters. However, the effective molding pressure between the two molds would be quite uneven if the closing pressure and the transverse contact pressure did not compensate one another.

The application of the closing pressure and the transverse contact pressure does not need to be constantly concurrent, it may be for example that the mold will first be closed and the closing pressure will be applied on the platens initially without any transverse contact pressure; and in a second step the mold will be moved against the injection sleeve and the transverse contact pressure will then be applied before molding starts.

Figure 6:
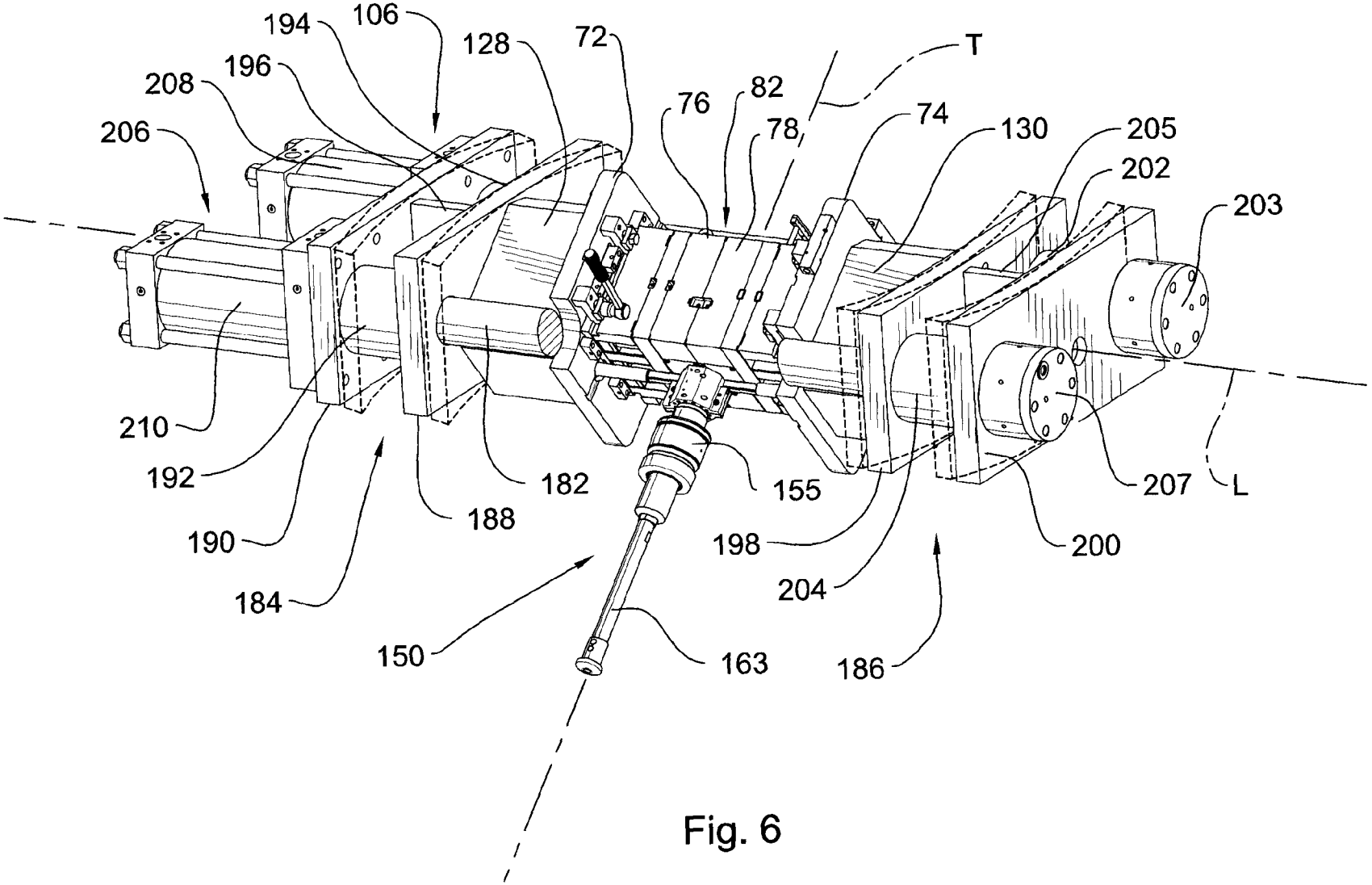
FIG. 6 is similar to FIG. 5 but with the injection sleeve and platens being in their injection position and with the resilient tie bar support members being shown deformed in dotted lines under effect of the mold closing pressure inducing mechanism, albeit in an exaggerated manner for illustrative purposes.

To further help evenly distribute the effective mold closing pressure between first and second mold portions 76, 78 at the parting line, tie bar support members 184, 186 are resilient and are allowed to deform when mold closing pressure inducing mechanism 106 is activated. More particularly, first and second tie bar support plates 188, 190 and 198, 200 are more resilient than platens 72, 74, and more particularly than the platen backrests 128, 130. Tie bar support plates 188, 190, 198, 200 are attached to platen backrests 128, 130 and protrude beyond their respective platen peripheral surfaces. Upon the mold closing pressure inducing mechanism 106 inducing the closing pressure via first and second tie bar support members 184, 186 and tie bars 180, 182 for forcing first and second platens 72, 74 towards their closed position, the tie bar support plates 188, 190, 198, 200 of first and second support members 184, 186 will resiliently deform in a direction generally parallel to longitudinal axis L and towards one another, as shown in FIG. 6. This will promote an even distribution of the closing pressure on platens 72, 74 and even more so at the mold parting line.

All steps from the ladle being filled with liquid metal at the furnace crucible, the liquid metal being conveyed from the furnace crucible to the injection sleeve, and then the injection and molding themselves, are to be repeated in a cycle to allow die casting machine 30 to create multiple metallic articles. This may be accomplished at high injection pressures to increase article quality that can be deployed at molding section 32, these high injection pressures being allowed due to the effective evenly distributed high molding pressure which in turn is allowed by the asymmetrical closing pressure distribution of the offset tie bars 180, 182 that allow the injection sleeve to be applied with more important transverse contact pressure.

The advantageous male-female seal between the injection sleeve and the mold also helps in preventing liquid metal from leaking out between the mold and the injection sleeve. In particular the female interface member 170 on the injection sleeve and the male interface member on the mold that help keep the mold closed.

The fact that the injection sleeve is applied entirely on the exterior of the mold helps ensure a proper closure of the mold. Indeed, if the mold were to close at least partly on the injection sleeve, the injection sleeve itself might hamper the mold in closing properly, especially as a result of thermal expansion of the injection sleeve.

The high production rate is also a result of the injection sleeve filling operation being accomplished with less turbulence that allows it to be done at a greater speed without spilling; and also to the liquid metal conveyance also being allowed to be accomplished at a greater speed since the inclination of the filled ladle 60 while it moves along rail member 142 allows for more important acceleration and deceleration with less turbulence and spilling.

While the injection and cooling steps occur at mold 82, ladle 60 will return to the furnace to be refilled and return to fill injection sleeve immediately as soon as possible, for example before the mold opens to eject the metallic article if there is enough space for ladle 60 to fill injection sleeve 155; or after the mold opens if not. One or more additional ladles may be provided to feed injection sleeve if using a single ladle would slow the process down, these additional ladles being filled either at the same furnace 34 as the first-named ladle 60, or at other furnaces if necessary.

It is understood that base 80 could have any other suitable configuration than that shown in the drawings, including separate base portions for the injection sleeve and the platens.

It is further understood that, within this specification, when reference is made to liquid metal, this includes any metal that may flow through the injection sleeve into the mold, including metal having a relatively high viscosity such as the so-called semi-solid metal. According to an alternate embodiment of the invention, the die casting machine could be a hot chamber die casting machine wherein the injection sleeve would be at least partly enclosed in a furnace and liquid metal would be selectively allowed to flow from the furnace into the injection sleeve inner chamber through a liquid metal filling port. This liquid metal filling port would be distinct from the liquid metal injection port. As with most hot chamber die casting machines, the injection sleeve would comprise a nozzle at the liquid metal injection port for allowing the injection of the liquid metal into the mold. No biscuit formation would occur during and after the injection. Within the present specification, the expression "injection sleeve" will be considered to include injection nozzle-type injection sleeves as typically used in hot chamber die casting machines.

Figure 12:
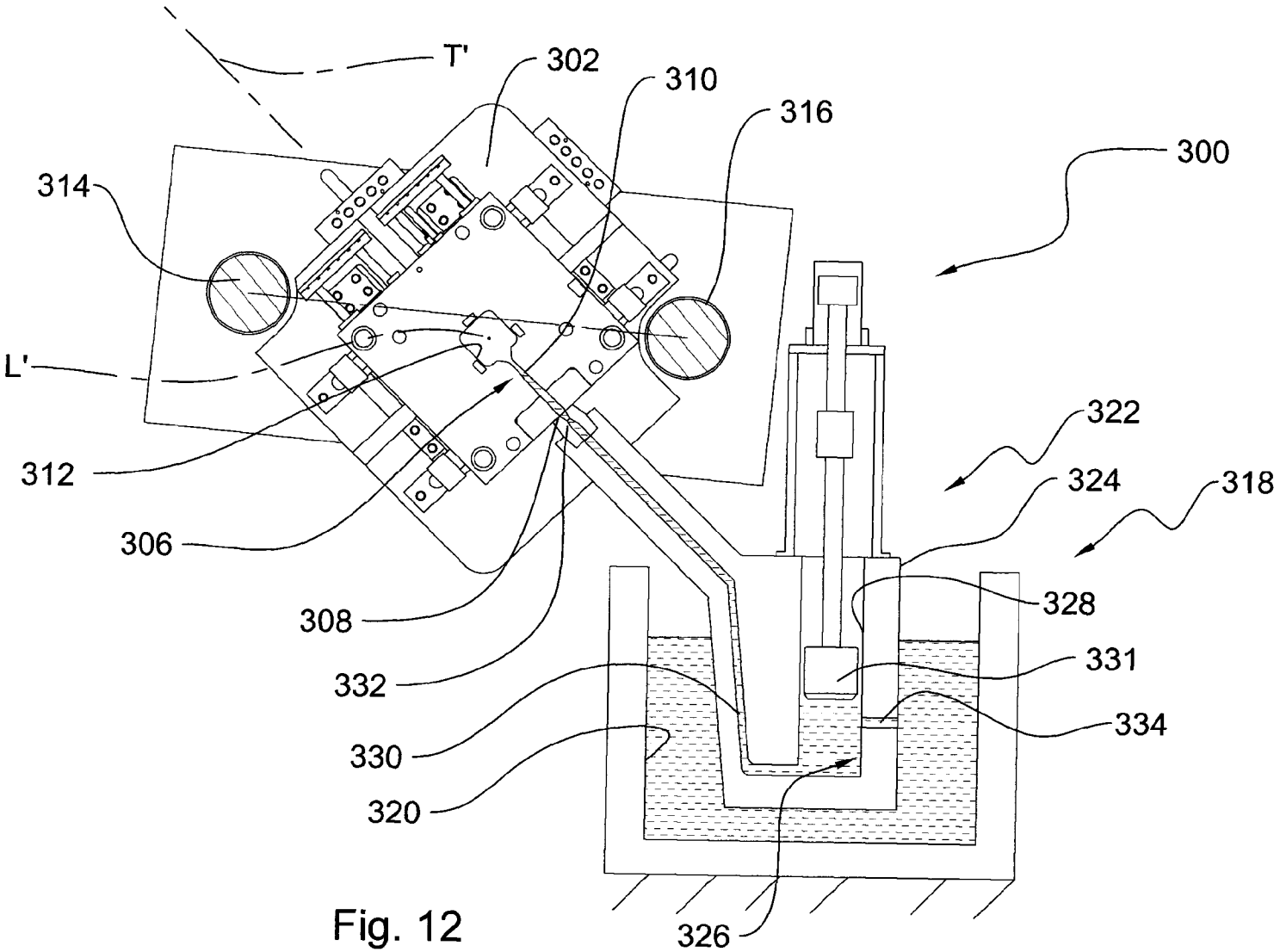
FIG. 12 is similar to FIG. 7 but shows an alternate embodiment of the invention wherein the die casting machine is a hot chamber die casting machine, FIG. 12 showing the hot chamber furnace and the gooseneck injection sleeve that is partly submerged therein.

FIG. 12 shows portions of a hot chamber die casting machine 300 that is similar in many aspects to the die casting machine 30 of the first embodiment. The platens, mold portions, mold closing actuators, longitudinal and transverse actuators and base are all similar to that of die casting machine 30.

FIG. 12, which is similar to the cross-sectional view of FIG. 7, shows one platen 302 holding one mold portion 304 in which a mold cavity 306 is defined. Mold cavity 306 has an inlet opening 308 leading into a runner 310 that in turn leads into an article cavity 312. As usual for hot chamber die casting molds, no biscuit cavity exists. A pair of tie bars 314, 316 extend parallel to the longitudinal axis L' of hot chamber die casting machine 300 and work like tie bars 180, 182 of the first embodiment.

Hot chamber die casting machine 300 also comprises a furnace 318 having a liquid metal bath 320 wherein liquid metal is provided. An injection mechanism 322 is used to inject liquid metal into the mold and comprises a gooseneck-type injection sleeve 324 having an inner chamber 326 generally divided in two portions: a first inner chamber portion 328 wherein an injector in the form of a plunger 331 is movable and a second, elbowed inner chamber portion 330 that leads to a nozzle 332. A liquid metal inlet port 334 is provided in the injection sleeve wall to allow liquid metal to flow into and partly fill inner chamber 326 when plunger 331 is retracted away from liquid metal inlet port 334. When plunger 331 is extracted into the inner chamber first portion 328, it will force the liquid metal out through the inner chamber second portion 330, nozzle 332 and into the mold cavity 306. In FIG. 12, the platens have been moved in their injecting position against the nozzle and the plunger is injecting liquid metal into the mold cavity 306.

It can be appreciated that the embodiment shown in FIG. 12 will work similarly to that of FIGS. 1-11 in that the tie bars 314, 316 are disposed asymmetrically relative to the longitudinal axis L' of die casting machine for unevenly distributing the closing pressure on the first and second platens for compensating an injection sleeve contact pressure along the transversal axis T' resulting from the injection sleeve 324 engaging the mold at the injecting position to have a resulting effective molding pressure on the mold portions that is substantially evenly distributed across the parting line.

The invention claimed is:

1. A cold chamber die casting machine comprising:

first and second platens each holding respective first and second mold portions, said first and second platens being mounted to a base and being movable relative to one another along a longitudinal axis between an open position in which said first and second mold portions are spaced apart and a closed position in which said first and second mold portions are pressed against each other along a parting line to form a mold;

a mold cavity formed between and enclosed by said first and second mold portions when said first and second platens are in their closed position;

a mold closing actuator capable of selectively inducing a closing pressure on said first and second platens for forcing said first and second platens towards their closed position;

an inlet opening formed on said mold at said parting line and allowing access into said mold cavity when said platens are in their closed position for injecting liquid metal into said mold cavity; and an injection mechanism mounted to said base comprising an injection sleeve having an inner chamber and a liquid metal injection port, and an injector for forcing liquid metal from said inner chamber out through said liquid metal injection port, said injector comprising a plunger movable within said inner chamber from a retracted position within said inner chamber to an extracted position within said inner chamber for forcing liquid metal out of said inner chamber, said plunger continually remaining substantially entirely within said inner chamber, said injection sleeve being movable relative to said mold along a transversal axis between a distal position in which said liquid metal injection port and said inlet opening are spaced apart; and an injection position in which said injection sleeve engages an exterior surface of said mold to form a seal about said inlet opening and said liquid metal injection port when said first and second platens are in their closed position, with said liquid metal injection port then being in liquid communication with said inlet opening for allowing liquid metal to be injected from said injection sleeve inner chamber into said mold cavity, with said transversal axis being transversal to said longitudinal axis, wherein said mold closing actuator comprises a device for unevenly distributing said closing pressure on said first and second platens for compensating an injection sleeve contact pressure along said transversal axis resulting from said injection sleeve engaging said mold at said injecting position, to have a resulting effective closing pressure on said mold portions that is substantially evenly distributed across said parting line.

2. A cold chamber die casting machine as defined in claim 1, further comprising:

a first male-female interface member provided on said injection sleeve around said liquid metal injection port; and a second male-female interface member provided on said mold around said inlet opening;

wherein said first and second male-female interface members are complementary to form a male-female engagement seal between said injection sleeve and said mold around said liquid metal injection port and said inlet opening when said injection sleeve and said mold are in said injection position.

3. A cold chamber die casting machine as defined in claim 2, wherein said first male-female interface member comprises a female interface member and said second male-female interface member comprises a male interface member.

4. A cold chamber die casting machine as defined in claim 3, wherein said male interface member comprises an annular convex outer surface and said female interface member comprises an annular concave outer surface engageable against said male interface member annular convex outer surface to create a male-female engagement seal about said inlet opening and said liquid metal injection port.

5. A cold chamber die casting machine as defined in claim 4, wherein said male interface member annular convex outer surface has a radius of curvature which is smaller than the radius of curvature of said female interface member annular concave outer surface at the point of contact between said male and female interface members when said male-female engagement seal is created, for providing a substantially linear circular contact between said male and female interface members.

6. A cold chamber die casting machine as defined in claim 4, wherein said injection sleeve is mounted to said base by means of a pivotal joint so as to be pivotable about an injection sleeve reference axis, said die casting machine further comprising an injection sleeve biasing member continuously biasing said injection sleeve towards said injection sleeve reference axis.

7. A cold chamber die casting machine as defined in claim 1, wherein said device for unevenly distributing said closure pressure on said first and second platens comprises tie bars parallel to said longitudinal axis and linked to said first and second platens, and a mold closing pressure inducing mechanism capable of inducing said closing pressure on said first and second platens via said tie bars for forcing said first and second platens towards their closed position, with said tie bars being disposed asymmetrically relative to said longitudinal axis for unevenly distributing said closing pressure on said first and second platens for compensating said injection sleeve contact pressure along said transversal axis resulting from said injection sleeve engaging said mold at said injecting position to have said resulting effective closing pressure on said mold portions that is substantially evenly distributed across said parting line.

8. A cold chamber die casting machine as defined in claim 7, wherein said tie bars are linked to said platens by means of tie bar support members that are more resilient than said platens and are allowed to resiliently deform when said closing pressure is applied to said first and second platens via said tie bar support members and said tie bars.

9. A cold chamber die casting machine as defined in claim 8, wherein said first platen defines a front side on which said first mold portion is installed, a back side opposite said front side and an outer peripheral surface extending between said front and back sides, said second platen defines a front side on which said second mold portion is installed, a back side opposite said front side and an outer peripheral surface extending between said front and back sides, wherein said tie bar support members comprise:

a first resilient tie bar support member attached to the first platen back side and protruding beyond the first platen peripheral surface; and a second resilient tie bar support member attached to the second platen back side and protruding beyond the second platen peripheral surface;

and wherein said mold closing pressure inducing mechanism induces said closing pressure on said first and second platens via said first and second tie bar support members and said tie bars for forcing said first and second platens towards their closed position, said first and second support members resiliently deforming in a direction generally parallel to said longitudinal axis and towards one another.

10. A cold chamber die casting machine as defined in claim 9, wherein said tie bars comprise a first and a second tie bars that are positioned in offset fashion opposite said injection sleeve relative to said longitudinal axis.

11. A cold chamber die casting machine as defined in claim 10, wherein said first tie bar support member is elongated and defines opposite end portions that protrude beyond said peripheral edge of said first platen, and said second tie bar support member is elongated and defines opposite end portions that protrude beyond said peripheral edge of said second platen, with said first tie bar engaging registering end portions of said first and second tie bar support members and said second tie bar engaging registering end portions of said first and second tie bar support members.

12. A cold chamber die casting machine as defined in claim 11, wherein said first tie bar support member comprises a pair of spaced-apart first tie bar support plates, with said first and second tie bars each extending through both said first tie bar support plates, and wherein said second tie bar support member comprises a pair of spaced-apart second tie bar support plates, with said first and second tie bars each extending through both said second tie bar support plates.

13. A cold chamber die casting machine as defined in claim 12, wherein said first tie bar support member further comprises a first web linking said first tie bar support plates between said first and second tie bars and wherein said second tie bar support member further comprises a second web linking said second tie bar support plates between said first and second tie bars.

14. A cold chamber die casting machine as defined in claim 13, wherein said mold closing pressure inducing mechanism comprises tie bar sockets that attach said tie bars at a first end thereof to said first tie bar support member and high-pressure hydraulic cylinders acting on said tie bars at a second end thereof and attached to said second tie bar support member.

15. A cold chamber die casting machine as defined in claim 1, wherein said injection sleeve is fixed in translation to said base and said platens are movably mounted to said base so as to allow said injection sleeve to be movable relative to said mold between said distal and injection positions.

16. A cold chamber die casting machine as defined in claim 15, wherein said platens are mounted to said base by means of a transverse track member that allows said platens to move towards and away from said injection sleeve along said transversal axis, said die casting machine comprising a platen transverse actuator for selectively moving said platens along said transverse track member towards and away from said injection sleeve.

17. A cold chamber die casting machine as defined in claim 16, wherein said transverse track member is parallel to said transversal axis and is fixedly supported on said base in an inclined fashion at an angle ranging between 1° and 90° relative to a horizontal plane so that said platens will move down as they move towards said injection sleeve and up as they move away from said injection sleeve.

18. A cold chamber die casting machine as defined in claim 17, wherein said injection sleeve is elongated and is inclined so as to be parallel to said transversal axis, with said injection sleeve liquid metal port being located higher than said injection sleeve inner chamber.

19. A cold chamber die casting machine as defined in claim 18, wherein said transversal axis has an angle of approximately 45° relative to a horizontal plane.

20. A cold chamber die casting machine as defined in claim 17, wherein said platens are carried by a longitudinal track member allowing said platens to move along said longitudinal axis, said longitudinal track member being in turn movable along said transverse track member, said die casting machine further comprising a platen longitudinal actuator for allowing said platens to move along said longitudinal track member.

21. A cold chamber die casting machine as defined in claim 18, wherein said mold cavity comprises an inner runner that extends away from said inlet opening in line with said injection sleeve.

22. A cold chamber die casting machine as defined in claim 1, wherein said die casting machine comprises a linear guide member attached to said base and linked to said plunger for guiding said plunger as it moves.

23. A cold chamber die casting machine as defined in claim 1, wherein said cold chamber die casting machine further comprises a plunger lubrication device for lubricating a head portion of said plunger.

* * * * *